US009341975B2

(12) United States Patent
Suzuki et al.

(10) Patent No.: US 9,341,975 B2
(45) **Date of Patent: *May 17, 2016**

(54) IMAGE FORMING APPARATUS

(71) Applicant: CANON KABUSHIKI KAISHA, Tokyo (JP)

(72) Inventors: Akimichi Suzuki, Yokohama (JP); Motoki Adachi, Ashigarakami-gun (JP); Yusuke Shimizu, Yokohama (JP); Yuichiro Hirata, Suntou-gun (JP); Naoki Fukushima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/690,181

(22) Filed: Apr. 17, 2015

(65) Prior Publication Data

US 2015/0220016 A1 Aug. 6, 2015

Related U.S. Application Data

(63) Continuation of application No. 14/060,991, filed on Oct. 23, 2013.

(30) Foreign Application Priority Data

Oct. 26, 2012 (JP) ..... 2012-236760
Dec. 13, 2012 (JP) ..... 2012-272617

(51) Int. Cl.

| | |
|---|---|
| ***G03G 15/02*** | (2006.01) |
| ***G03G 15/043*** | (2006.01) |
| ***G03G 15/01*** | (2006.01) |
| ***G03G 15/00*** | (2006.01) |

(52) U.S. Cl.

CPC ..... *G03G 15/0266* (2013.01); *G03G 15/011* (2013.01); *G03G 15/043* (2013.01); *G03G 15/0189* (2013.01); *G03G 15/5037* (2013.01); *G03G 2215/0132* (2013.01)

(58) Field of Classification Search

CPC ..... G03G 15/0266; G03G 15/011; G03G 15/0189; G03G 15/043; G03G 15/5037; G03G 15/5029; G03G 2215/0132

See application file for complete search history.

(56) References Cited

U.S. PATENT DOCUMENTS

| | | | | |
|---|---|---|---|---|
| 8,886,060 | B2 * | 11/2014 | Kakigi | 399/26 |
| 9,116,456 | B2 * | 8/2015 | Suzuki | G03G 15/011 |
| 2004/0096236 | A1 * | 5/2004 | Shin | 399/88 |
| 2005/0047839 | A1 * | 3/2005 | Shimizu et al. | 399/333 |
| 2013/0259543 | A1 * | 10/2013 | Katagiri et al. | 399/302 |
| 2013/0279927 | A1 * | 10/2013 | Kihara et al. | 399/50 |
| 2014/0147139 | A1 * | 5/2014 | Hasegawa et al. | 399/50 |
| 2014/0178087 | A1 * | 6/2014 | Suzuki et al. | 399/50 |

* cited by examiner

*Primary Examiner* — WB Perkey

(74) *Attorney, Agent, or Firm* — Canon U.S.A., Inc. IP Division

(57) ABSTRACT

An image forming apparatus includes an exposure device configured to expose image bearing members charged by charging devices to form latent images on the image bearing members, and a control unit configured to, in ether one or both of an image forming unit A and an image forming unit B, adjust an amount of exposure by which the image bearing member is exposed and a charging voltage based on information about the image bearing members of the image forming units A and B. The control unit is configured to make the charging voltage and the amount of exposure in the image forming unit A different from the charging voltage and the amount of exposure in the image forming unit B.

18 Claims, 29 Drawing Sheets

| | Y | M | C | K |
|---|---|---|---|---|
| FILM THICKNESS (μm) | 16 | 14 | 12 | 10 |
| Vd (V) | -490 | -508 | -527 | -508 |
| VL (V) | -114 | -125 | -135 | -125 |
| AMOUNT OF EXPOSURE (μJ/cm$^2$) | 0.311 | | | 0.331 |
| CHARGING BIAS (V) | 1029 | | | 992 |
| TRANSFER BIAS (V) | 300 | | | |

| | Y | M | C | K |
|---|---|---|---|---|
| FILM THICKNESS (μm) | 16 | 14 | 12 | 10 |
| Vd (V) | -490 | -508 | -527 | -545 |
| VL (V) | -114 | -125 | -135 | -145 |
| AMOUNT OF EXPOSURE (μJ/cm$^2$) | 0.311 | | | 0.331 |
| CHARGING BIAS (V) | 1029 | | | 992 |
| TRANSFER BIAS (V) | 300 | | | |

| | Y | M | C | K |
|---|---|---|---|---|
| FILM THICKNESS (μm) | 16 | 14 | 12 | 10 |
| Vd (V) | -490 | -508 | -527 | -490 |
| VL (V) | -114 | -125 | -135 | -125 |
| AMOUNT OF EXPOSURE (μJ/cm²) | 0.311 | | | 0.331 |
| CHARGING BIAS (V) | 1029 | | | 992 |
| TRANSFER BIAS (V) | 300 | | | |

FIG. 16

| | COLOR | Y | M | C | K |
|---|---|---|---|---|---|
| | FILM THICKNESS(μm) | 13 | 10 | 16 | 13 |
| CONVENTIONAL EXAMPLE | Vd(V) | -517 | -545 | -490 | -517 |
| | VL(V) | -130 | -145 | -114 | -130 |
| | CHARGING BIAS(V) | -1029 | -1029 | -1029 | -1029 |
| EXEMPLARY EMBODIMENT WITH REFERENCE TO C | Vd(V) | -490 | -490 | -490 | -490 |
| | VL(V) | -114 | -114 | -114 | -114 |
| | CHARGING BIAS(V) | -1002 | -974 | -1029 | -1002 |
| EXEMPLARY EMBODIMENT WITH REFERENCE TO M | Vd(V) | -545 | -545 | -545 | -545 |
| | VL(V) | -145 | -145 | -145 | -145 |
| | CHARGING BIAS(V) | -1057 | -1029 | -1084 | -1057 |

IMAGE FORMING APPARATUS

CROSS-REFERENCE TO RELATED APPLICATIONS

The present application is a continuation of U.S. patent application Ser. No. 14/060,991 entitled "IMAGE FORMING APPARATUS" and filed on Oct. 23, 2013, which claims priority from Japanese Patent Applications No. 2012-236760 filed Oct. 26, 2012 and No. 2012-272617 filed Dec. 13, 2012, all of which are hereby incorporated by reference herein in their entirety.

BACKGROUND OF THE INVENTION

1. Field of the Invention

The present invention relates to an image forming apparatus.

2. Description of the Related Art

Color image forming apparatuses using an electrophotographic method or an electrostatic recording method have been increasing. Various types of printers, copying machines, and facsimiles (FAXes) are on the market.

As a representative example, a rotary type image forming apparatus has been discussed. A plurality of developing devices containing toners of respective different colors is prepared for a single photosensitive drum (electrophotographic photosensitive member) serving as an image bearing member. The plurality of developing devices successively develops electrostatic latent images on the photosensitive drum. Specifically, a rotating developing device (referred to as a rotary or carousel) integrally including developing devices of four colors, e.g., yellow, magenta, cyan, and black, is arranged near a single photosensitive drum. Electrostatic latent images are formed on the common photosensitive drum. The electrostatic latent images are visualized as toner images in a development position where the developing devices are rotated to reach. A primary transfer unit transfers the toner images formed on the photosensitive drum to an intermediate transfer belt. The color toner images are successively and selectively superposed on one another to form a multicolor toner image on the intermediate transfer belt. The multicolor tone image is then transferred to a transfer material in a collective manner.

As another method, an inline color image forming apparatus has been discussed. The image forming apparatus of such a method includes a plurality of photosensitive drums serving as image bearing members. The photosensitive members are opposed to respective color developing devices, which separately form toner images of respective colors. Primary transfer units successively transfer the toner images from the respective photosensitive drums to a transfer belt to form a superposed toner image in four colors. A secondary transfer unit then transfers the toner image to a transfer material in a collective manner to form an image.

Inline color image forming apparatuses have recently been becoming mainstream because the inline color image forming apparatuses are more advantageous than rotary type color image apparatuses in terms of the productivity of color prints. However, since a plurality of photosensitive drums needs to be used to separately perform image formation, the inline color image forming apparatuses have the disadvantage of increased complexity. To deal with this disadvantage, Japanese Patent Application Laid-Open No. 2011-158676 discusses using a common power supply to apply high voltages to a plurality of primary transfer members.

According to the technique discussed in Japanese Patent Application Laid-Open No. 2011-158676, the image forming apparatus can be simplified. However, if photosensitive drums having different degrees of wear are mounted on stations (image forming units), it is difficult to maintain both favorable transferability and retransferability in all the stations.

The reason is that a charged portion potential (Vd) and an exposed portion potential (VL) vary from one station to another depending on the degrees of wear of the photosensitive drums in the stations.

Transferability refers to the characteristic of moving toner (developer) from a photosensitive drum to an intermediate transfer belt (transfer member). The transferability depends mainly on a difference (transfer contrast) between the exposed portion potential and the potential of a primary transfer member. Retransferability refers to the characteristic that the toner transferred to the intermediate transfer belt returns to the photosensitive drum. The retransferability depends mainly on a difference (retransfer contrast) between the charged portion potential and the potential of the primary transfer member. The potential of the primary transfer member can be set to increase the rate of the developer moving from the photosensitive drum to the intermediate transfer belt and reduce the rate of the developer returning from the intermediate transfer belt to the photosensitive drum.

According to the configuration discussed in Japanese Patent Application Laid-Open No. 2011-158676, the potentials of the primary transfer members in the respective stations cannot be independently controlled. If the charged portion potential and the exposed portion potential of the photosensitive drums vary from one station to another, the retransfer contrast and the transfer contrast also vary station by station. In such a case, some of the stations may fail to maintain favorable transferability and/or retransferability.

SUMMARY OF THE INVENTION

The present invention is directed to an image forming apparatus in which a plurality of image forming units shares a transfer power supply and which can suppress variations in the charged portion potential and the exposed portion potential between the image bearing members.

According to an aspect of the present invention, an image forming apparatus includes a plurality of image forming units configured to form a developer image, wherein each of the plurality of image forming units includes an image bearing member on which a latent image is able to be formed, a charging device configured to charge the image bearing member, a developing device configured to develop the latent image into a developer image, and a transfer device configured to transfer the developer image from the image bearing member to a transfer member, wherein in a predetermined image forming unit A and image forming unit B among the plurality of image forming units, a common transfer voltage is applied to the respective transfer devices from a common transfer power supply and charging voltages are applied to the respective charging devices from different charging power supplies, wherein the image forming apparatus further includes an exposure device configured to expose the image bearing members charged by the charging devices to form the latent images on the image bearing members, and a control unit configured to, in either one or both of the image forming units A and B, adjust an amount of exposure by which the image bearing member is exposed and the charging voltage based on information about the image bearing members of the image forming units A and B, and wherein the control unit is configured to make the charging voltage and the amount of exposure in the image forming unit A different from the charging voltage and the amount of exposure in the image forming unit B.

Further features of the present invention will become apparent from the following description of exemplary embodiments with reference to the attached drawings.

BRIEF DESCRIPTION OF THE DRAWINGS

FIG. 16 is a chart illustrating the potentials of the stations according to the third exemplary embodiment of the present invention and the conventional example.

DESCRIPTION OF THE EMBODIMENTS

Various exemplary embodiments, features, and aspects of the invention will be described in detail below with reference to the drawings.

Dimensions, materials, shapes, and relative arrangements of components described in exemplary embodiments of the present invention may be modified as appropriate, depending on the configurations and various conditions of apparatuses to which the exemplary embodiments of the present invention are applied. In other words, the scope of the present invention is not intended to be limited to the following exemplary embodiments.

An image forming apparatus to which an exemplary embodiment of the present invention is applied is the one using an electrophotographic method or an electrostatic recording method. In the following description, an exemplary embodiment of the present invention is described to be applied to a laser beam printer which receives image information from a host computer and outputs an image. The image forming apparatus according to the present exemplary embodiment is configured so that photosensitive drums serving as electrophotographic photosensitive members, other process units, and consumables such as toner serving as a developer are integrally configured as process cartridges. The process cartridges can be detachably attached to an image forming apparatus main body.

Figure 1:
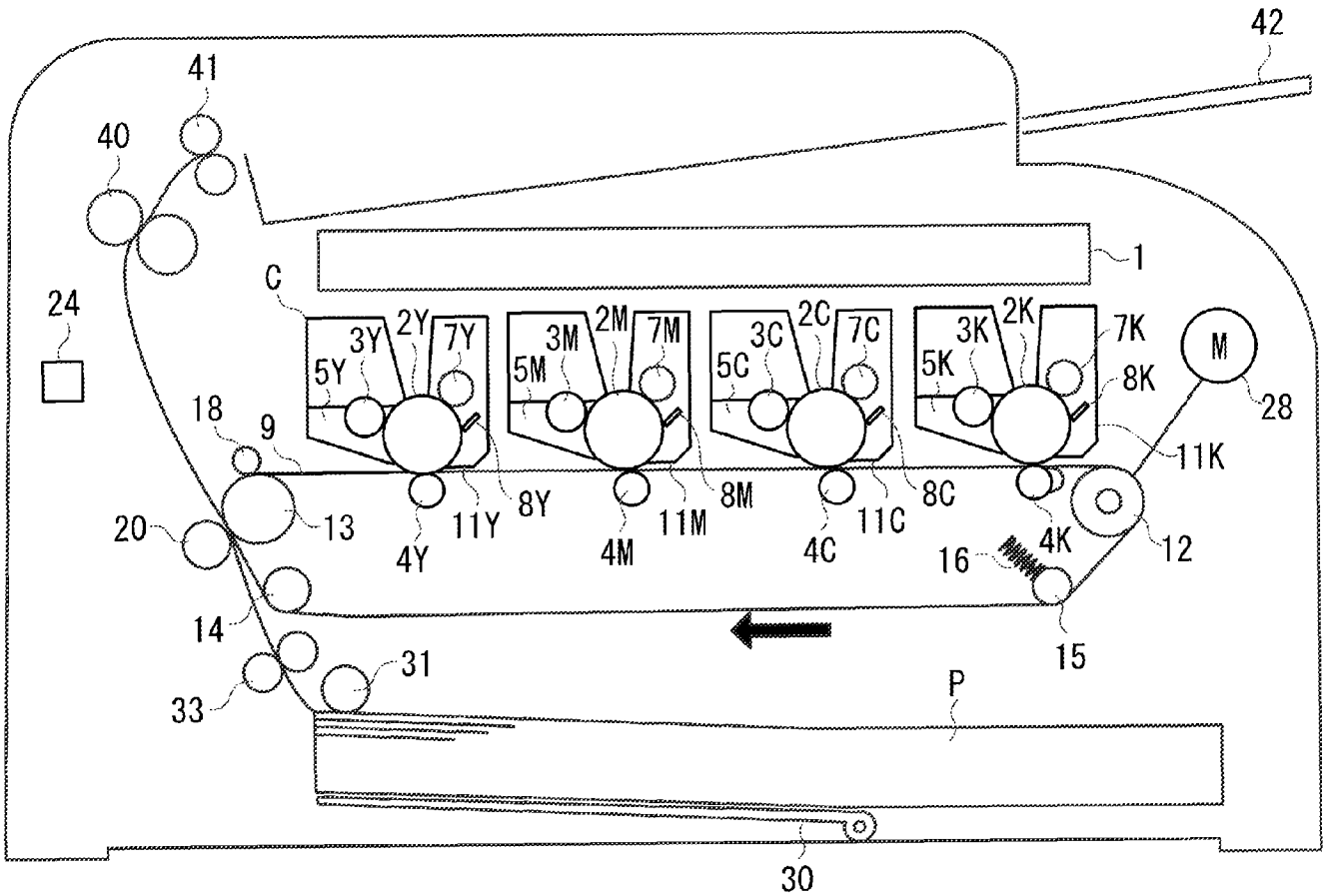
FIG. 1 is a schematic diagram illustrating a configuration of an image forming apparatus according to an exemplary embodiment of the present invention.

FIG. 1 is a schematic diagram illustrating a configuration of an image forming apparatus according to a first exemplary embodiment of the present invention. In the present exemplary embodiment, each process cartridge C integrally includes a photosensitive drum 2, a charging roller 7, a developing roller 3, a developing device 5, and a cleaning unit 11. The charging roller 7 is a charging unit (charging device) for uniformly charging the photosensitive drum 2 serving as an image bearing member. The developing roller 3 serving as a developing unit is opposed to the photosensitive drum 2. The developing device 5 is connected to the developing roller 3. The developing device 5 includes a toner container which is a developer storage unit storing toner (developer). The cleaning unit 11 includes a cleaning blade 8 and a waste toner container. The waste toner container stores residual toner removed from the photosensitive drum 2 by the cleaning blade 8.

The image forming apparatus according to the present exemplary embodiment includes four process cartridges C having the same configuration, corresponding to four (yellow, magenta, cyan, and black) color toners, respectively. The process cartridges C are configured to be detachably attached to the image forming apparatus main body. The image forming apparatus according to the present exemplary embodiment is an inline image forming apparatus. As illustrated in FIG. 1, the process cartridges C are arranged in order of yellow, magenta, cyan, and black. The process cartridge C of each color is combined with a primary transfer roller to constitute a station (image forming unit) which forms a developer image (toner image). Each process cartridge C includes a not-illustrated nonvolatile memory to be described below. The nonvolatile memory stores film thickness (layer thickness) information about the photosensitive drum 2 of that color.

Figure 2:
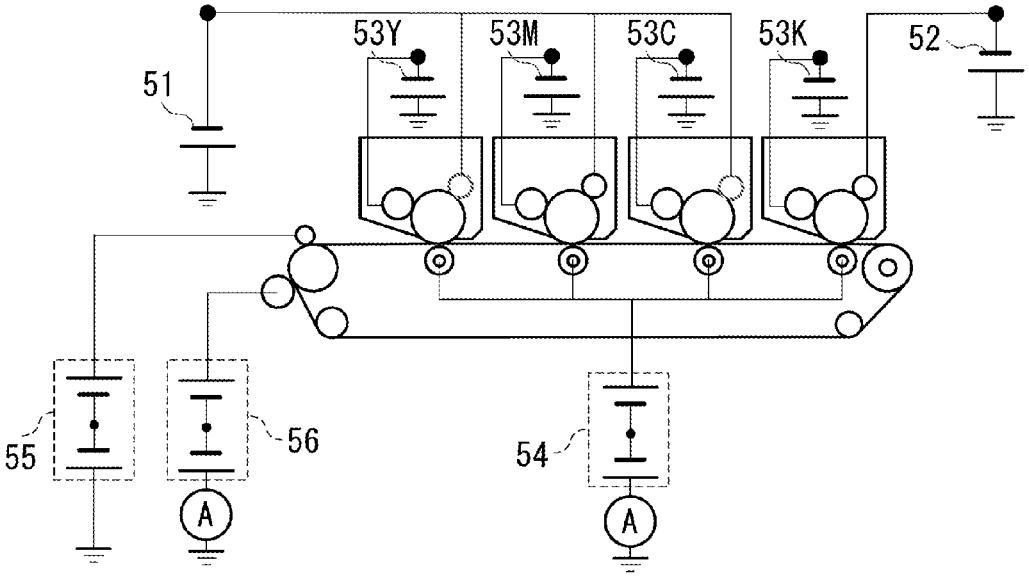
FIG. 2 is a schematic diagram illustrating a configuration of high-voltage bias supply sources of the image forming apparatus according to the exemplary embodiment of the present invention.

FIG. 2 is a schematic diagram illustrating a configuration of high-voltage bias supply sources of the image forming apparatus according to the present exemplary embodiment. The image forming apparatus according to the present exemplary embodiment will be described with reference to FIGS. 1 and 2. The process cartridges C, the image forming units, and/or members constituting the same may be described by using reference numerals with additional letters Y (yellow), M (magenta), C (cyan), and K (black) corresponding to the respective toner colors if needed.

The photosensitive drums (electrophotographic photosensitive members) 2 each include a grounded 24-mm-diameter drum base made of conductive aluminum material. A photosensitive member layer including an ordinary organic photoconductor (OPC) layer is formed and applied onto the outer periphery of the drum base. The photosensitive member layer includes a not-illustrated stack of an undercoat layer (UCL), a charge carrier generation layer (CGL), and a charge carrier transport layer (CTL).

As illustrated in FIG. 2, a charging high-voltage power supply 51 serving as a charging bias application unit (charging power supply) supplies a direct-current high-voltage bias to charging rollers 7. The charging high-voltage power supply 51 is common to the yellow (Y), magenta (M), and cyan (C) stations (image forming units). The charging high-voltage power supply 51 is connected to the charging rollers 7Y, 7M, and 7C. A charging high-voltage power supply (charging power supply) 52 is a direct-current high-voltage power supply for charging the black (K) photosensitive drum 2K. The charging high-voltage power supply 52 is connected to the charging roller 7K. The stations independently include respective developing high-voltage power supplies 53Y, 53M, 53C, and 53K, which are connected to the developing rollers 3Y, 3M, 3C, and 3K, respectively.

The image forming apparatus can select and execute a monochrome mode for forming a monochrome image and a color mode for forming a color image. The black (K) station is a station that is used not only in the color mode but also in the monochrome mode (monochrome image forming unit). The black (K) station thus includes the independent charging high-voltage power supply 52. On the other hand, the yellow (Y), magenta (M), and cyan (C) stations are stations that are used only in the color mode (color image forming units). The three stations share the charging high-voltage power supply 51.

As illustrated in FIG. 1, an intermediate transfer belt 9 is arranged in a position opposed to the photosensitive drums 2. The intermediate transfer belt 9 serves as an intermediate transfer member to which toner images formed on the surfaces of the photosensitive drums 2 are primarily transferred. The intermediate transfer belt 9 is stretched across an intermediate transfer belt driving roller 12, a secondary transfer counter roller 13, an intermediate transfer belt tension roller 15, and an intermediate transfer belt driven roller 14. The intermediate transfer belt 9 is a 100-μm-thick endless resin belt to which an ion conductive agent is added to adjust volume resistivity to approximately $10^{10}$ Ωcm. In the present exemplary embodiment, the intermediate transfer belt 9 is made of polyvinylidene difluoride (PVDF), whereas other materials may be used. Examples include resin materials such as polyethylene naphthalate (PEN), polyimide, polycarbonate, polyethylene, polypropylene, polyamide, polysulfone, polyarylate, polyethylene terephthalate, polyethersulfone, and thermoplastic polyimide. An acrylic or other cured resin layer may be formed on the surface of such resin materials.

The intermediate transfer belt driving roller 12 includes a hollow aluminum tube having an outer diameter of 24 mm. The aluminum tube is coated with a 0.5-mm-thick ethylene propylene diene monomer (EPDM) rubber to provide an electrical resistance of $10^5$Ω or less. An intermediate transfer belt driving motor 28 drives the intermediate transfer belt driving roller 12 to rotate, whereby the intermediate transfer belt 9 is rotated in the direction of the arrow. The intermediate transfer belt tension roller 15 is biased in one direction by an intermediate transfer belt tension spring 16, whereby a predetermined tension is applied to the intermediate transfer belt 9. Primary transfer rollers (transfer devices) 4Y, 4M, 4C, and 4K are arranged in positions opposed to the photosensitive drums 2 with the intermediate transfer belt 9 therebetween.

As illustrated in FIG. 2, a primary transfer high-voltage power supply 54 serving as a transfer bias application unit (transfer power supply) is connected to the primary transfer rollers 4Y, 4M, 4C, and 4K in parallel. With such a configuration, the same primary transfer bias (transfer voltage) is applied to the stations (image forming units). The primary transfer high-voltage power supply 54 is configured so that a high-voltage supply source having a positive polarity (opposite to a toner charging polarity) and a high-voltage supply source having a negative polarity are superposed on each other. The high-voltage supply source of the positive polarity is used during image formation. The high-voltage supply source of the negative polarity is used when cleaning the intermediate transfer belt 9.

As illustrated in FIG. 1, an intermediate transfer belt cleaning roller 18 for removing toner (residual toner) adhering to the intermediate transfer belt 9 is arranged on the intermediate transfer belt 9. The intermediate transfer belt cleaning roller 18 is driven to rotate by the intermediate transfer belt 9.

As illustrated in FIG. 2, a cleaning high-voltage power supply 55 is connected to the intermediate transfer belt cleaning roller 18. The cleaning high-voltage power supply 55 is configured so that a high-voltage supply source having a positive polarity (opposite to the toner charging polarity) and a high-voltage supply source having a negative polarity are superposed on each other. The supply source of the positive polarity is used during image formation. The high-voltage supply source of the negative polarity is used when cleaning the intermediate transfer belt cleaning roller 18.

As illustrated in FIG. 1, a secondary transfer roller 20 is arranged in a position opposed to the secondary transfer counter roller 13 with the intermediate transfer belt 9 therebetween. In the present exemplary embodiment, a roller including a stainless steel (SUS) core coated with a 6-mm-thick conductive foam rubber was used as the secondary transfer roller 20. The secondary transfer roller 20 had a hardness of 30 degrees (Asker C under a load of 4.9 N (500 gf)), an outer diameter of 18 mm, and an electrical resistance of $1\times10^7\Omega$. To determine the electrical resistance, the secondary transfer roller 20 was put into contact with an aluminum cylinder having an outer diameter of 30 mm, with a pressure of 5 N applied to each end of the core (not illustrated) of the secondary transfer roller 20. The secondary transfer roller 20 was thereby driven to rotate. A direct-current voltage of +1 kV was applied to the core (not illustrate), and the flowing current was measured to determine the electrical resistance. The secondary transfer roller 20 is biased in one direction by a not-illustrated spring to form a secondary transfer nip portion. The secondary transfer roller 20 is driven to rotate by the intermediate transfer belt 9.

As illustrated in FIG. 2, a secondary transfer high-voltage power supply 56 is connected to the secondary transfer roller 20. The secondary transfer high-voltage power supply 56 is configured so that a supply source having a positive polarity (opposite to the toner charging polarity) and a high-voltage supply source having a negative polarity are superposed on each other. The supply source of the positive polarity is used during image formation. The high-voltage supply source of the negative polarity is used when cleaning the secondary transfer roller 20.

As illustrated in FIG. 1, the image forming apparatus includes an environment sensor (temperature detection unit and humidity detection unit) 24. The environment sensor can detect temperature and humidity in and near the image forming apparatus.

In the present exemplary embodiment, photosensitive drum use amount information calculated based on photosensitive drum rotation time is used as a parameter about the film thicknesses (layer thickness) of the photosensitive member layers of the photosensitive drums 2. The photosensitive drum use amount information corresponds to the amount of use of a photosensitive drum calculated based on a damage index of the photosensitive drum, which is discussed in Japanese Patent No. 3285785.

Figure 3:
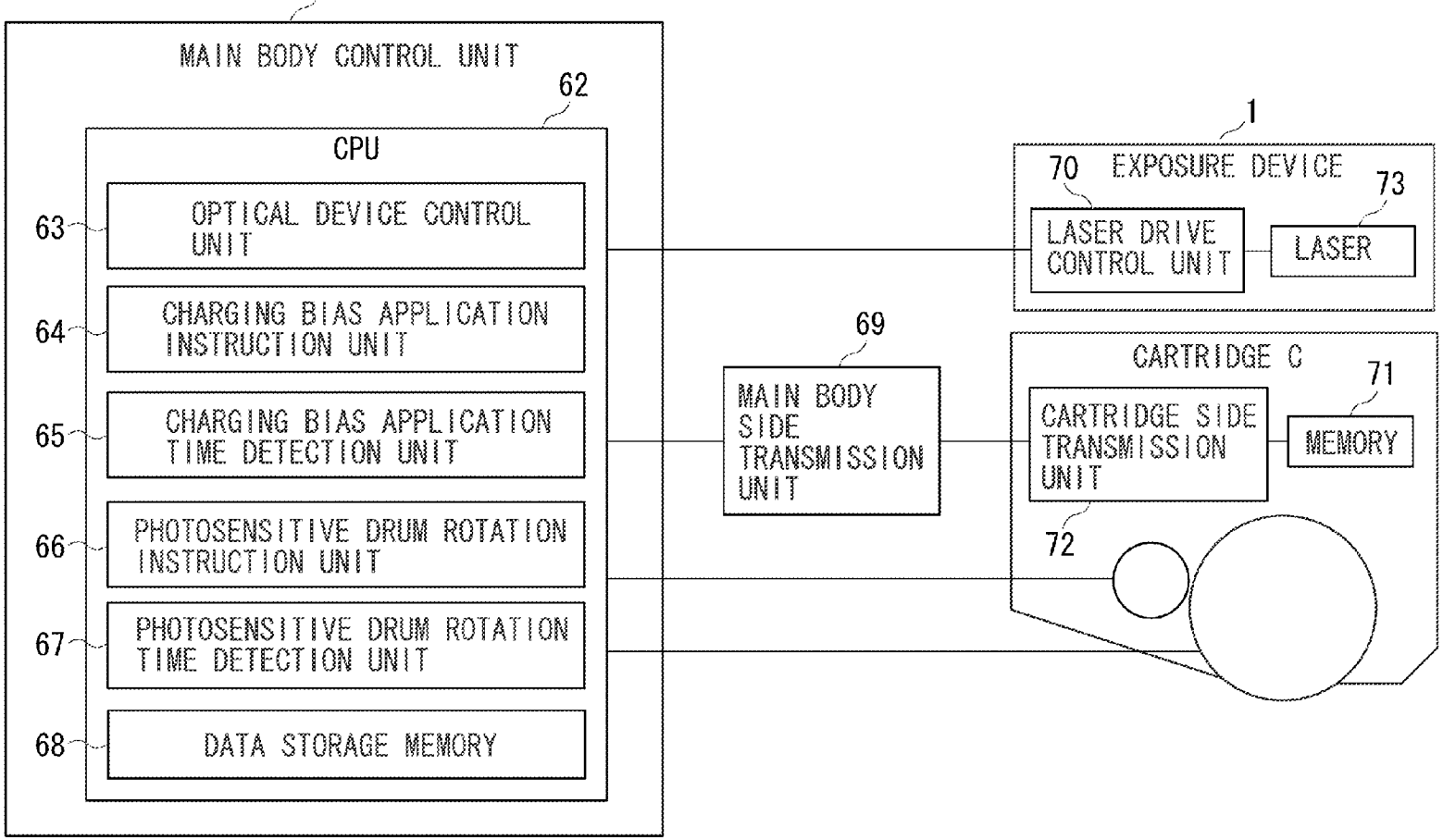
FIG. 3 is a block diagram illustrating a control configuration of the image forming apparatus according to the exemplary embodiment of the present invention.

FIG. 3 is a block diagram illustrating a control configuration of the image forming apparatus according to the present exemplary embodiment. FIG. 3 illustrates an overview of interface units between a process cartridge C, an exposure device 1, and a main body control unit 61. As illustrated in FIG. 3, the main body control unit 61 includes a central processing unit (CPU) 62. The CPU 62 includes an optical device control unit 63, a charging bias application instruction unit 64, a charging bias application time detection unit 65, a photosensitive drum rotation instruction unit 66, a photosensitive drum rotation time detection unit 67, and a data storage memory 68. The CPU 62 is connected to a main body side transmission unit 69 and a laser drive control unit 70 included in the exposure device 1. The process cartridge C includes a memory 71 and a cartridge side transmission unit 72. Such components constitute a layer thickness detection unit according to an exemplary embodiment of the present invention.

The memory 71 in the process cartridge C stores various information. Examples include cartridge drive time information T, drum use amount calculation equation coefficient information $\phi$, photosensitive member use amount threshold information $\alpha$, and information describing a table for setting an image formation condition corresponding to the photosensitive member use amount information $\alpha$. The drum use amount calculation equation coefficient information $\phi$ is a weighting factor for calculating a photosensitive member use amount. The photosensitive member use amount threshold information $\alpha$ and the photosensitive member use amount calculation equation coefficient information $\phi$ are stored in the memory 71 at the time of shipment of the process cartridge C. Such values vary depending on drum sensitivity, drum materials, the contact pressure of the cleaning blade 8, and electrical characteristics of the charging roller 7. The values are therefore stored in the memory 71 of each process cartridge C on shipment.

When the image forming apparatus main body receives a print image, the photosensitive member rotation instruction unit 66 drives the process cartridge C to start image formation processing. Here, the CPU 62 calculates a drum use amount D by the formula $D=A+B\times\phi$. The calculated drum use amount D is accumulated and stored in the data storage memory 68 of the main body control unit 61. B is an accumulated value of photosensitive drum rotation time data (equivalent to the foregoing cartridge drive time information T) from the photosensitive member rotation instruction unit 66. A is an accumulated value of charging bias application time data from the charging bias application time detection unit 65. $\phi$ is the weighting factor read from the memory 71.

The photosensitive drum rotation time data and the charging bias application time data are stored in the data storage memory 68 anytime. The data on the drum use amount D is calculated whenever the photosensitive drum 2 stops being driven. The calculated drum use amount D may be written to the data storage memory 68 instead of the photosensitive drum rotation time data and the charging bias application time data being stored in the data storage memory 68.

In the present exemplary embodiment, the process cartridge C includes the memory 71 and the cartridge side transmission unit 72. The memory 71 is arranged in a front part of the waste toner container in the mounting direction. The cartridge side transmission unit 72 is intended to control reading and writing of information from/to the memory 71. The cartridge side transmission unit 72 has a function of transmitting transmitted data to the memory 71 to write the data to the memory 71, or reading data from the memory 71. The cartridge side transmission unit 72 and the memory 71 are integrally configured on a substrate and attached to the process cartridge C. The cartridge side transmission unit 72 and the memory 71 are arranged so that when the process cartridge C is mounted on the image forming apparatus main body, the cartridge side transmission unit 72 and the main body side transmission unit 69 of the image forming apparatus main body come to opposed positions and make contact with each other. The main body side transmission unit 69 functions as a transmission unit on the image forming apparatus main body side. The main body side transmission unit 69 is connected to the main body control unit 61 of the image forming apparatus main body. Ordinary semiconductor-based electronic memories may be used as the memory 71 used in an exemplary embodiment of the present invention without particular restrictions. For example, an electrically erasable programmable read-only memory (EEPROM) and a ferroelectric random access memory (FeRAM) may be used as the memory 71.

The foregoing description has dealt with the case where the cartridge side transmission unit 72 and the main body side transmission unit 69 make contact with each other to form a data communication path and perform read/write data communication. However, the data communication may be performed without contact by using electromagnetic waves. In such a case, antenna members (not illustrated) intended to communicate using electromagnetic waves may be provided both on the cartridge side and the image formation apparatus main body side.

The cartridge side transmission unit 72, the main body side transmission unit 69, and the main body control unit 61 enable reading and writing of information from/to the memory 71. The memory 71 has a capacity sufficient to store a plurality of pieces of information including a cartridge use amount and a cartridge characteristic value to be described below.

Use amount information about the process cartridge C is also written to the memory 71 anytime. The use amount information about the process cartridge C stored in the memory 71 is not particularly limited as long as the information can be determined by the image formation apparatus main body. Examples include rotation time of units such as the photosensitive drum 2, the charging roller 7, and the developing roller 3, bias application time of the charging roller 7 and the developing roller 3, the remaining amount of toner, and the number of printed sheets. Other examples include the number of image dots formed on the photosensitive member, an accumulated value of laser light emission time for which the photosensitive member is exposed, a value obtained by combining various weighted use amounts, and a value calculated by using various use amounts.

At the start of an image forming operation, a transfer material (recording material) P in a cassette 30 is initially fed by a feed roller 31 and then conveyed to a registration roller pair 33. Here, the registration roller pair 33 is not rotating. The transfer material P is struck against the registration roller pair 33, whereby a skew of the transfer material P is corrected.

Take, for example, the yellow photosensitive drum 2Y. Initially, in parallel with the conveyance operation of the transfer material P, the charging roller 7Y uniformly negatively charges the surface of the photosensitive drum 2Y. The exposure device (exposure unit) 1 then performs image exposure. As a result, an electrostatic latent image corresponding to a yellow image component of an image signal is formed on the surface of the photosensitive drum 2Y.

Next, the developing unit 3Y comes into contact with the photosensitive drum 2Y. The developing unit 3Y develops and visualizes the electrostatic latent image into an yellow toner image by using negatively charged yellow toner. The resulting yellow toner image is primarily transferred to the intermediate transfer belt 9 by the primary transfer roller 4Y to which the primary transfer bias is supplied.

Such a series of toner image forming operations is also performed on the other photosensitive drums 2M, 2C, and 2K in succession at predetermined timing. Primary transfer units form transfer electric fields by using the high-voltage biases supplied from the high-voltage power supplies. The color toner images formed on the respective photosensitive drums 2 are superposed and primarily transferred to the intermediate transfer belt 9 in succession by the respective transfer electric fields. The image formation from the step of charging the photosensitive drums 2 to a primary transfer step will be described below.

The four color toner images superposed and successively transferred to the intermediate transfer belt 9 are moved to the secondary transfer nip portion by the rotation of the intermediate transfer belt 9 in the direction of the arrow. The transfer material P corrected for a skew by the registration roller pair 33 is sent to the secondary transfer nip portion in synchronization with the images on the intermediate transfer belt 9. The secondary transfer roller 20 secondarily transfers the four color toner images on the intermediate transfer belt 9 to the transfer material P in a collective manner. The transfer material P with the transferred toner images is conveyed to a fixing device 40. The fixing device 40 heats and presses the transfer material P to fix the toner images. The transfer material P is then discharged and stacked on a discharge tray 42 by a discharge roller pair 41.

After the end of the secondary transfer, the intermediate transfer belt cleaning roller 18 arranged near the secondary transfer counter roller 13 removes untransferred toner remaining on the surface of the intermediate transfer belt 9.

The image forming apparatus described above is an image forming apparatus of the intermediate transfer belt (ITB) type. In other words, the intermediate transfer belt 9 serves as a transfer material to which the photosensitive drums 2 transfer toner images (developer images). However, the image forming apparatus may be of the electrostatic transfer belt (ETB) type where the transfer belt conveys a recording material. In such a case, the recording material constitutes the transfer material.

Figure 4:
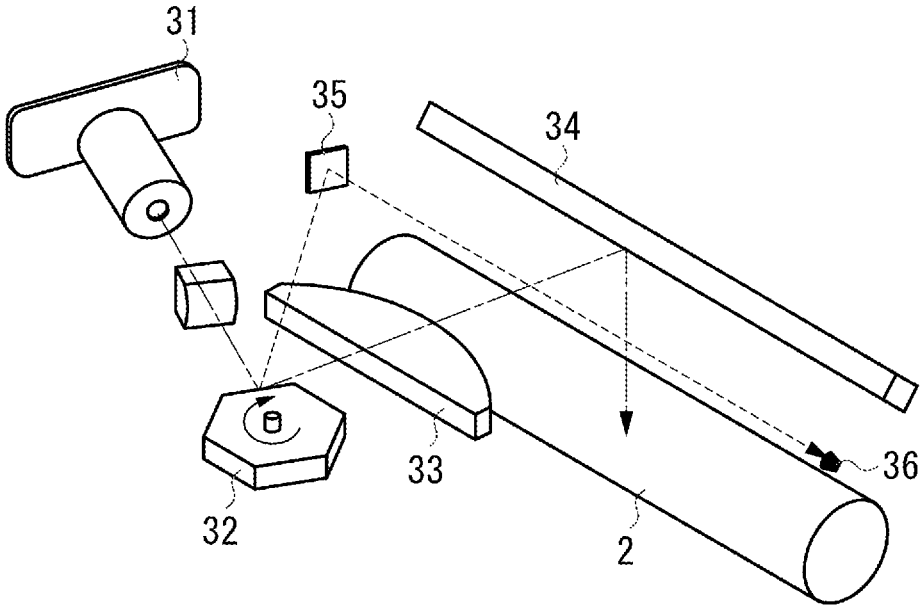
FIG. 4 is a schematic diagram illustrating a configuration of an exposure device of the image forming apparatus according to the exemplary embodiment of the present invention.

FIG. 4 is a diagram illustrating a configuration of the exposure device 1 included in the image forming apparatus according to the present exemplary embodiment. Collimated light taken out from a laser unit 31 is reflected, deflected, and scanned by a rotating polygonal mirror 32. The resulting scan beam passes an fθ lens 33 and a reflecting mirror 34 in succession, and reaches the surface of a photosensitive drum 2. A part of the scan beam is reflected by a beam detection (BD) mirror 35 and optically detected by a BD sensor 36. An output signal from the BD sensor 36 is used as a reference to synchronize a write signal in each scan round, thereby preventing deviations in the writing position of the scan beam. The output signal is also used for scanner motor rotation control. The laser unit 31 includes a semiconductor laser, a collimator lens bonded and fixed to a collimator lens barrel, and a laser driving substrate. The laser driving substrate supplies an electric current (driving current) needed for the semiconductor laser to emit light, and controls ON/OFF the light emission. The semiconductor laser includes an edge emitting laser chip and a photodiode.

Figure 5:
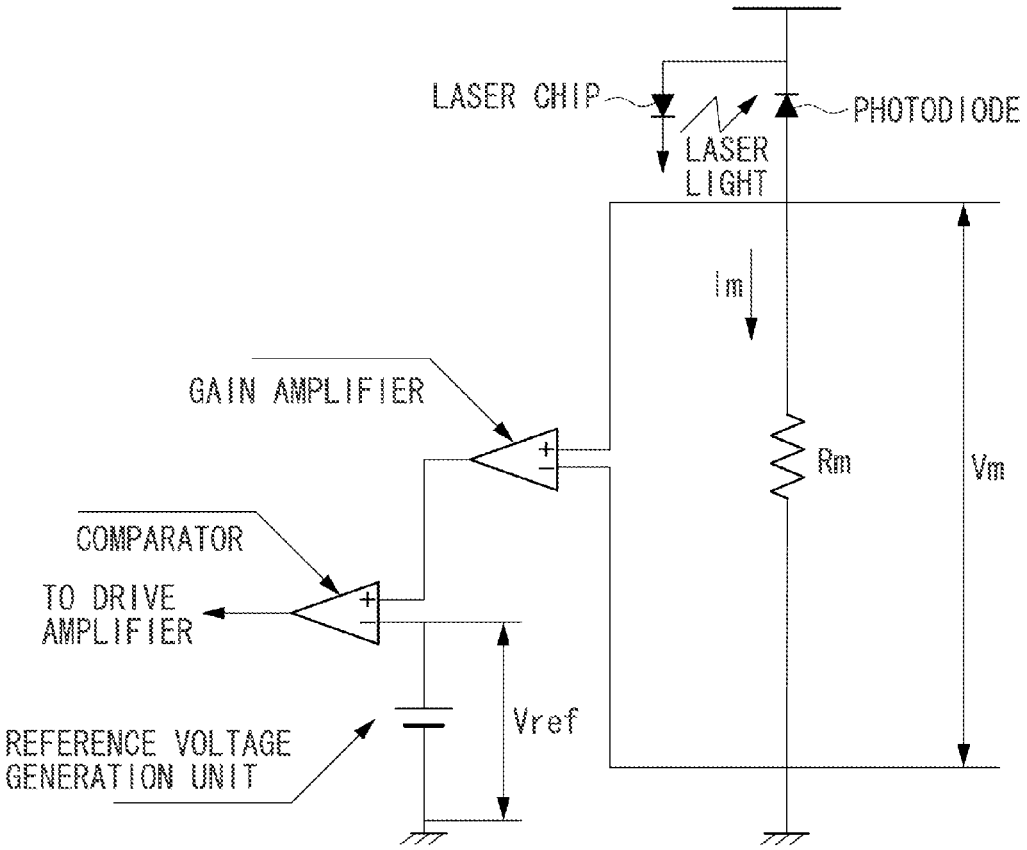
FIG. 5 is a circuit diagram illustrating an automatic power control (APC) circuit of the image forming apparatus according to the exemplary embodiment of the present invention.

FIG. 5 is a circuit diagram illustrating an APC circuit that controls the amount of light of the semiconductor laser to be constant. The photodiode receives laser light emitted from the laser chip, and photoelectrically converts the laser light into a monitor current Im. A resistor Rm converts the monitor current Im into a monitor voltage Vm. The monitor voltage Vm is amplified by a gain amplifier and input to a comparator. The comparator compares the monitor voltage Vm with a reference voltage Vref of a reference voltage generation unit. The APC circuit performs feedback control on the current input to the laser chip so that the monitor voltage Vm amplified by the gain amplifier coincides with the reference voltage Vref. The monitor voltage Vm, the resistor Rm, and the monitor current Im satisfy the following relationship:

$$Im = Vm/Rm \quad (1)$$

For an APC (automatic light amount adjustment) operation, the APC circuit gradually increases the value of the driving current of the semiconductor laser. If the amount of laser light reaches a preset target value W1 (mW), the APC circuit fixes the value of the driving current of the semiconductor laser to the value I1 [A] at that time and ends the APC operation. To change the target value W1 of the amount of laser light, the optical device control unit 63 in the CPU 62 of the image forming apparatus issues an instruction to change the reference voltage Vref and the APC circuit performs the APC operation.

The present exemplary embodiment is configured so that the common primary transfer bias is applied to the stations.

The yellow (Y), magenta (M), and cyan (C) photosensitive drums 2Y, 2M, and 2C may have different film thicknesses. In such a case, the charged portion potential (Vd) and the exposed portion potentials (VL) vary from one photosensitive drum to another, which makes it difficult to ensure compatibility between transferability and retransferability among the stations. An exemplary embodiment of the present invention is intended to address such a problem. A detailed description thereof will be given below.

The photosensitive drums 2 used in the present exemplary embodiment are manufactured so that their charge carrier transport layer has a film thickness (hereinafter, referred to as a photosensitive drum film thickness or film thickness) of 16 μm. The photosensitive drum film thickness decreases when the photosensitive drums 2 in use undergo mechanical friction and/or repetitive discharges. The film thickness is set to be approximately 10 μm when the life of the photosensitive drums 2 expires.

In the case of a charging roller method, the photosensitive drums 2 start to be charged at above a discharge threshold of approximately −550 V. To charge the photosensitive drums 2 to −500 V, a direct-current voltage of −1050 V, therefore, needs to be applied. More specifically, suppose that a charging roller 7 is pressed into contact with a 16-μm-thick OPC photosensitive member. If a voltage of approximately −550 V or higher is applied, the surface potential of the photosensitive member starts to increase. Subsequently, the surface potential of the photosensitive member linearly increases with a gradient of approximately 1 with respect to the applied voltage. Such a threshold voltage will be defined as a charge start voltage Vth. To obtain a photosensitive member surface potential Vd needed for image formation, a direct-current voltage of Vd+Vth needs to be applied to the charging roller 7.

Figure 6:
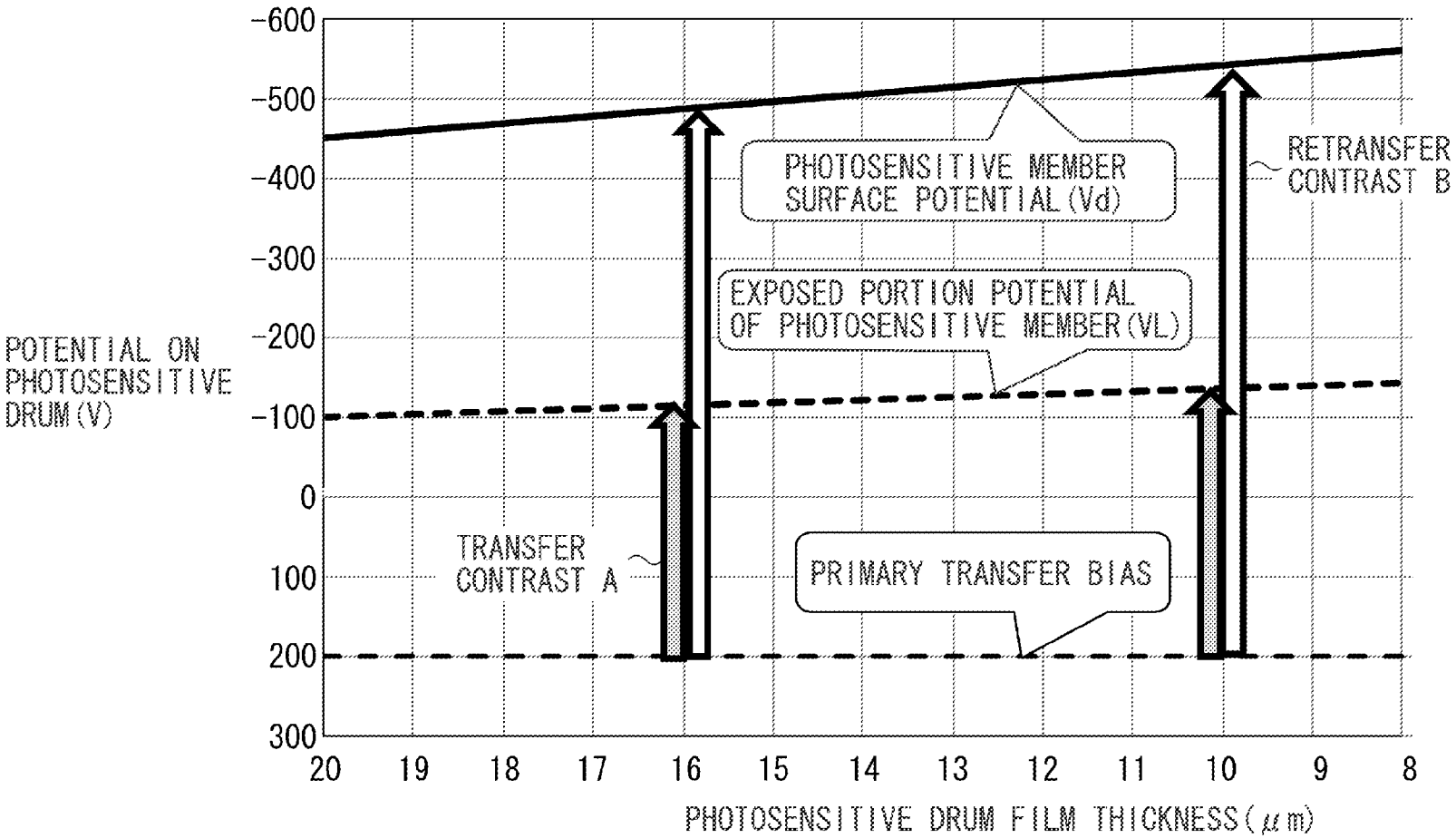
FIG. 6 is a chart illustrating the relationship of potentials to a photosensitive drum film thickness.

According to the charging roller method using the direct-current voltage, the resistance of the charging roller 7 varies with variations in the environment. The charge start voltage Vth also varies when the photosensitive member is worn to change in the film thickness. As a result, the photosensitive member varies in potential. FIG. 6 illustrates variations of the photosensitive member surface potential Vd with respect to the film thickness with a charging bias of −1050 V. It can be seen that with the constant charging bias, the magnitude (absolute value) of the potential (Vd) of the charged photosensitive drum 2 increases as the film thickness decreases. In other words, to maintain constant Vd, the magnitude (absolute value) of the charging bias needs to be reduced as the film thickness decreases.

The charged portion of the photosensitive member changes to an exposed portion potential of VL when exposed by the exposure unit 1. VL also varies with the film thickness, i.e., the degree of use of the photosensitive member. Possible reasons for the variations include that the number of residual charges in the photosensitive member layer increases due to the exposure of the photosensitive member for image formation. In particular, in a low absolute humidity environment, some of the layers in the photosensitive member layer increase in resistance. This hinders smooth transfer and injection of charges, and VL tends to increase.

FIG. 6 illustrates variations of VL with respect to the film thickness of the photosensitive drum 2 with an exposure intensity of 0.311 $\mu J/cm^2$ on the surface of the photosensitive drum 2.

Next, a trade-off mechanism between transferability and retransferability will be described. The following description deals with a case where the stations of the image forming apparatus use a common primary transfer bias, and photosensitive drums 2 having different degrees of wear are mounted on the respective stations.

Transfer refers to the process of moving a toner image (developer image) lying on a photosensitive drum 2 to the intermediate transfer belt 9 serving as a transfer material, and a phenomenon in which the toner bearing a charge is transferred by an electric field formed between the two members. The toner on the photosensitive drum 2 is borne on the exposed portion of the photosensitive drum 2 by an electrostatic adhesion force of the toner's charge and non-electrostatic adhesion forces such as liquid-bridging force and the van der Waals force. Meanwhile, a bias having a polarity opposite to that of the toner's charge is applied to the transfer member (in the present exemplary embodiment, transfer roller 4) to form a transfer electric field between the photosensitive drum 2 and the intermediate transfer belt 9. The transfer electric field generates the Coulomb force on the toner. Transfer is possible on the condition that the Coulomb force exceeds the adhesion forces of the toner to the photosensitive drum 2. From the viewpoint of transferability, a transfer contrast that is a difference between the exposed portion potential VL of the photosensitive drum 2 and the potential of the transfer member is desired to be increased.

Retransfer refers to a phenomenon in which the toner transferred to the intermediate transfer belt 9 is reversely transferred to a photosensitive drum 2 in a station lying downstream in the conveyance direction of the intermediate transfer belt 9. In a primary transfer nip portion of the downstream station, the charge borne by the toner on the intermediate transfer belt 9 may be attenuated or reversed by a discharge between the potential of the transfer member and the charged portion potential Vd of the photosensitive drum 2. In such a case, the toner moves to the photosensitive drum 2 of the downstream station to cause the retransfer phenomenon. From the viewpoint of the retransfer, a retransfer contrast, which is a difference between the charged portion potential Vd of the photosensitive drum 2 and the potential of the transfer member, is desired to be reduced.

The stations use the common primary transfer bias. From the viewpoint of the transferability, a high primary transfer bias is desirably applied to increase the transfer contrast. From the viewpoint of the retransfer, the selection of a high primary transfer bias increases the retransfer contrast and deteriorates the retransferability. As has been described, there is a tradeoff between the transferability and the retransferability. This may cause an image defect and/or increase the amount of residual toner on the photosensitive drums 2.

A concrete description will be given with reference to FIG. 6. FIG. 6 is a chart illustrating the relationship of potentials to the photosensitive drum film thickness. Suppose that photosensitive drums 2 having a film thickness of 16 μm and 10 μm are mounted on respective different stations, and the stations use the common primary transfer bias. To ensure transferability, the primary transfer bias is set to 200 V so that a necessary transfer contrast A (FIG. 6) can be provided with reference to the 16-μm photosensitive drum 2 which has an exposed portion potential VL of the smallest absolute value. From the viewpoint of the retransfer, the 10-μm station having a charged portion potential Vd of the largest absolute value is the most disadvantageous. The retransfer level depends on a retransfer contrast B (FIG. 6).

As can be seen from above, to ensure compatibility between the transferability and the retransferability, it is effective to reduce differences in the charged portion potential Vd and the exposed portion potential VL among the stations.

Figure 7:
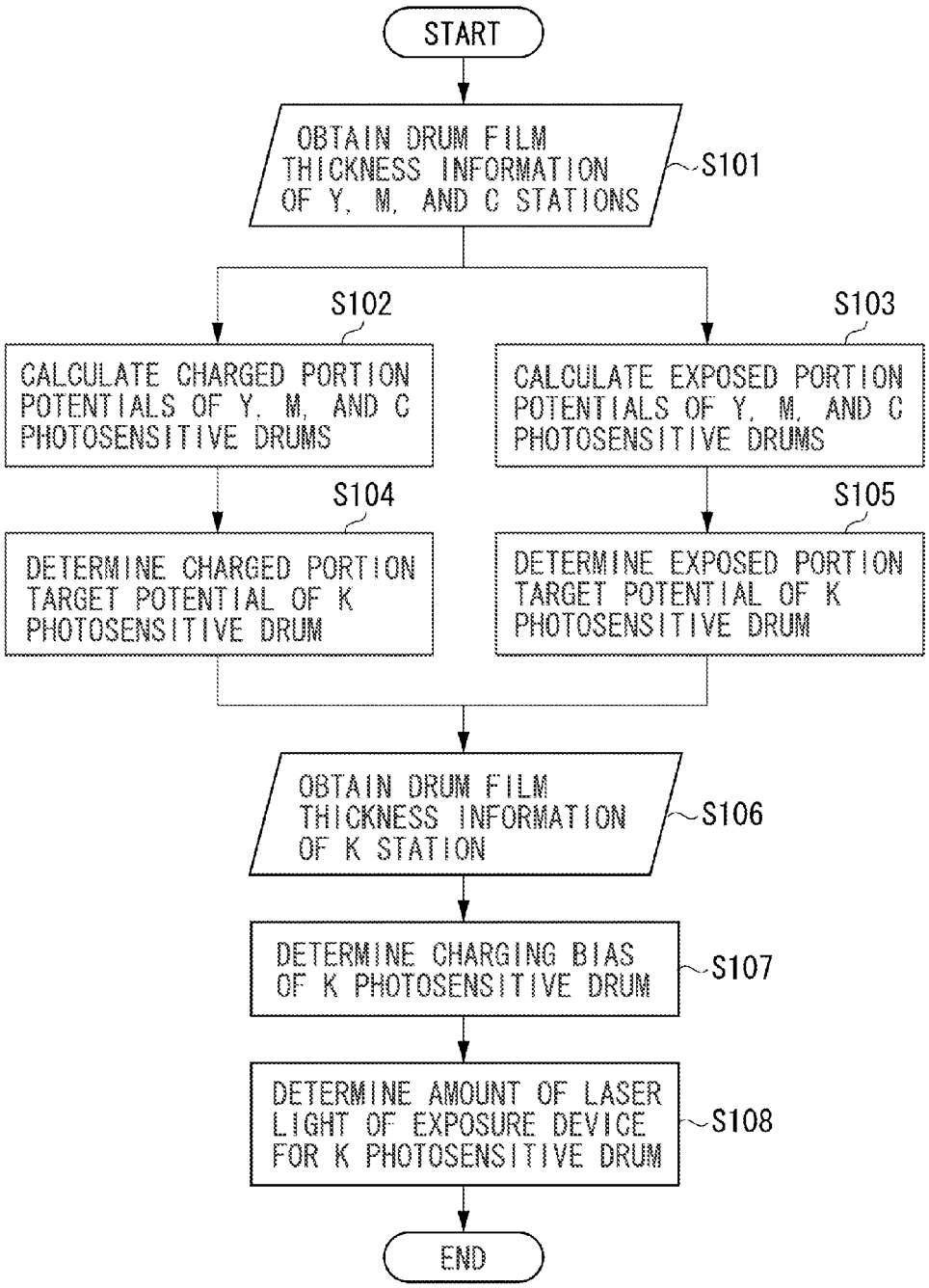
FIG. 7 is a flowchart illustrating a control follow of image forming units according to the exemplary embodiment of the present invention.

A control flow of the image forming units according to the present exemplary embodiment will be described with reference to FIG. 7. FIG. 7 is a flowchart illustrating the control flow of the image forming units according to the present exemplary embodiment. In step S101, the main body control unit 61 receives an instruction to start image formation, and obtains drum film thickness information of the yellow (Y), magenta (M), and cyan (C) stations (image forming units B) from the memories 71 in the process cartridges C. In the present exemplary embodiment, as described above, the photosensitive drum use amount information is used as the information about the film thicknesses of the photosensitive drums 2.

In step S102, the main body control unit 61 determines the charged portion potentials Vd of the photosensitive drums 2 in the yellow (Y), magenta (M), and cyan (C) stations (image forming units B) based on the obtained drum film thickness information. At the same time, in step S103, the main body control unit 61 determines the exposed portion potentials VL of the yellow (Y), magenta (M), and cyan (C) photosensitive drums 2Y, 2M, and 2C. The yellow (Y), magenta (M), and cyan (C) stations use a common charging bias and a common exposure intensity (amount of laser light) on the photosensitive drum surfaces, which are −1029 V and 0.311 μJ/cm$^2$, respectively.

The main body control unit 61 determines the charged portion potentials Vd and the exposed portion potentials VL by deriving regression equations from correlations between the film thickness and the charged portion potential Vd and between the film thickness and the exposed portion potential VL. The correlations have been experimentally determined by the inventors in advance. If environmental and/or other corrections are needed, the main body control unit 61 may add corrections according to environmental information. For example, if the yellow (Y) photosensitive drum 2Y has a film thickness of 16 μm, the relationship illustrated in FIG. 6 shows that Vd=−490 V and VL=−114 V.

In steps S104 and S105, the main body control unit 61 determines charged portion and exposed portion target potentials of the black (K) photosensitive drum 2K based on potential information about Vd and VL of the yellow (Y), magenta (M), and cyan (C) photosensitive drums 2Y, 2M, and 2C determined in steps S102 and S103. In the present exemplary embodiment, the main body control unit 61 determines the charged portion and exposed portion target potentials of the black (K) photosensitive drum 2K to be respective average values of the potentials of the yellow (Y), magenta (M), and cyan (C) photosensitive drums 2Y, 2M, and 2C.

In step S106, the main body control unit 61 obtains drum film thickness information of the black (K) station from the memory 71 in the process cartridge C. In step S107, the main body control unit 61 determines the charging bias of the black (K) photosensitive drum 2K from the charged portion target potential of the black (K) photosensitive drum 2K determined in step S104. In step S108, the main body control unit 61 determines the amount of laser light of the exposure device 1 for the black (K) photosensitive drum 2K from the exposed portion target potential of the black (K) photosensitive drum 2K determined in step S105.

Figure 8:
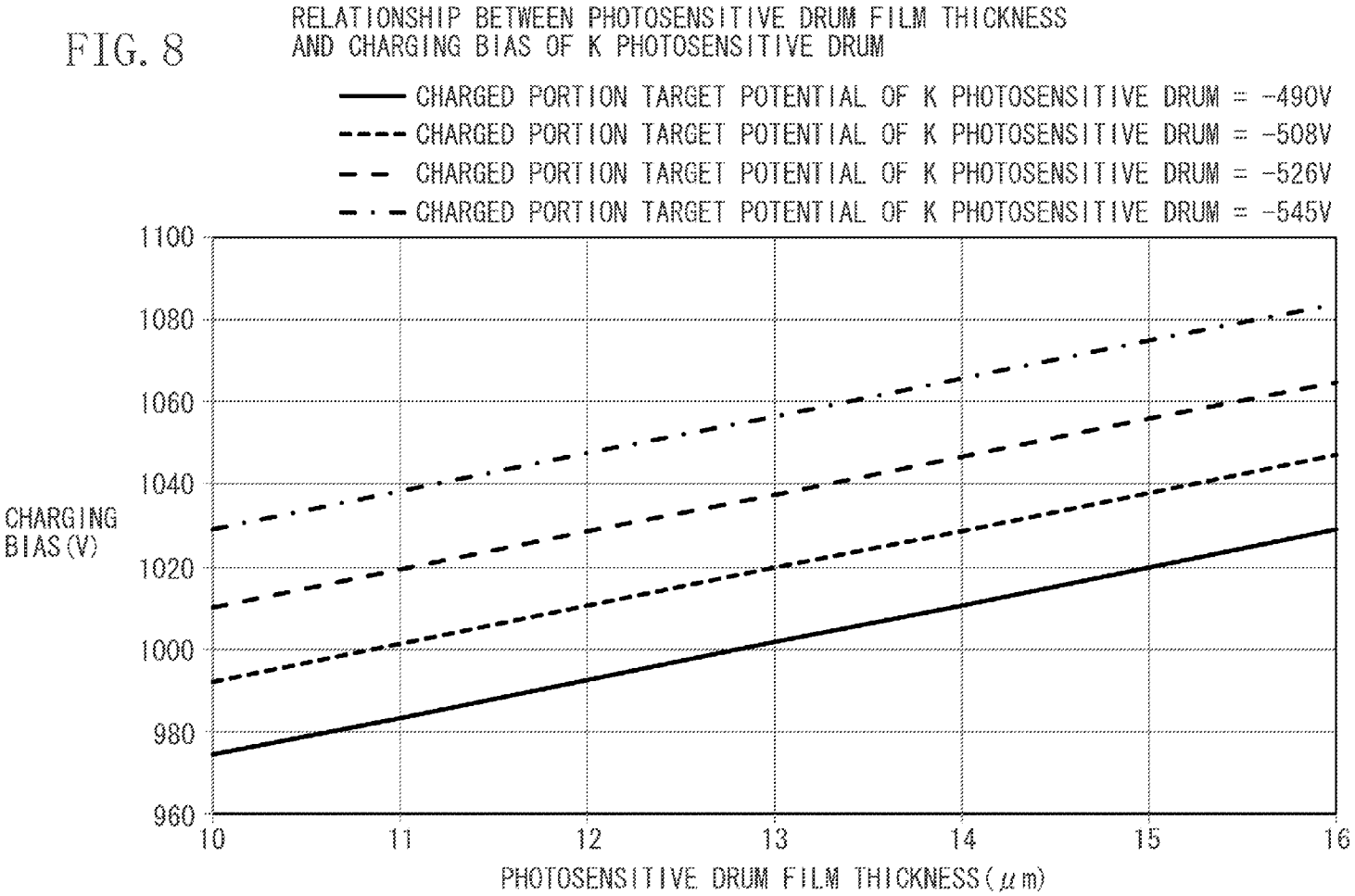
FIG. 8 is a chart illustrating the relationship of a charging bias to the photosensitive drum film thickness.

The main body control unit 61 determines the charging bias by interpolating relationships between the photosensitive drum film thickness and the charging bias at respective charged portion target potentials of the black (K) photosensitive drum 2K illustrated in FIG. 8. FIG. 8 is a chart illustrating the relationship of the charging bias to the photosensitive drum film thickness. It can be seen that to suppress variations in the potential of a charged photosensitive drum 2, the magnitude (absolute value) of the charging bias needs to be reduced as the film thickness decreases. For example, if the black (K) photosensitive drum 2K has a photosensitive drum film thickness of 10 μm and the charged portion target potential is −508 V, the charging bias can be set to −992 V based on the relationship illustrated in FIG. 8.

Figure 9:
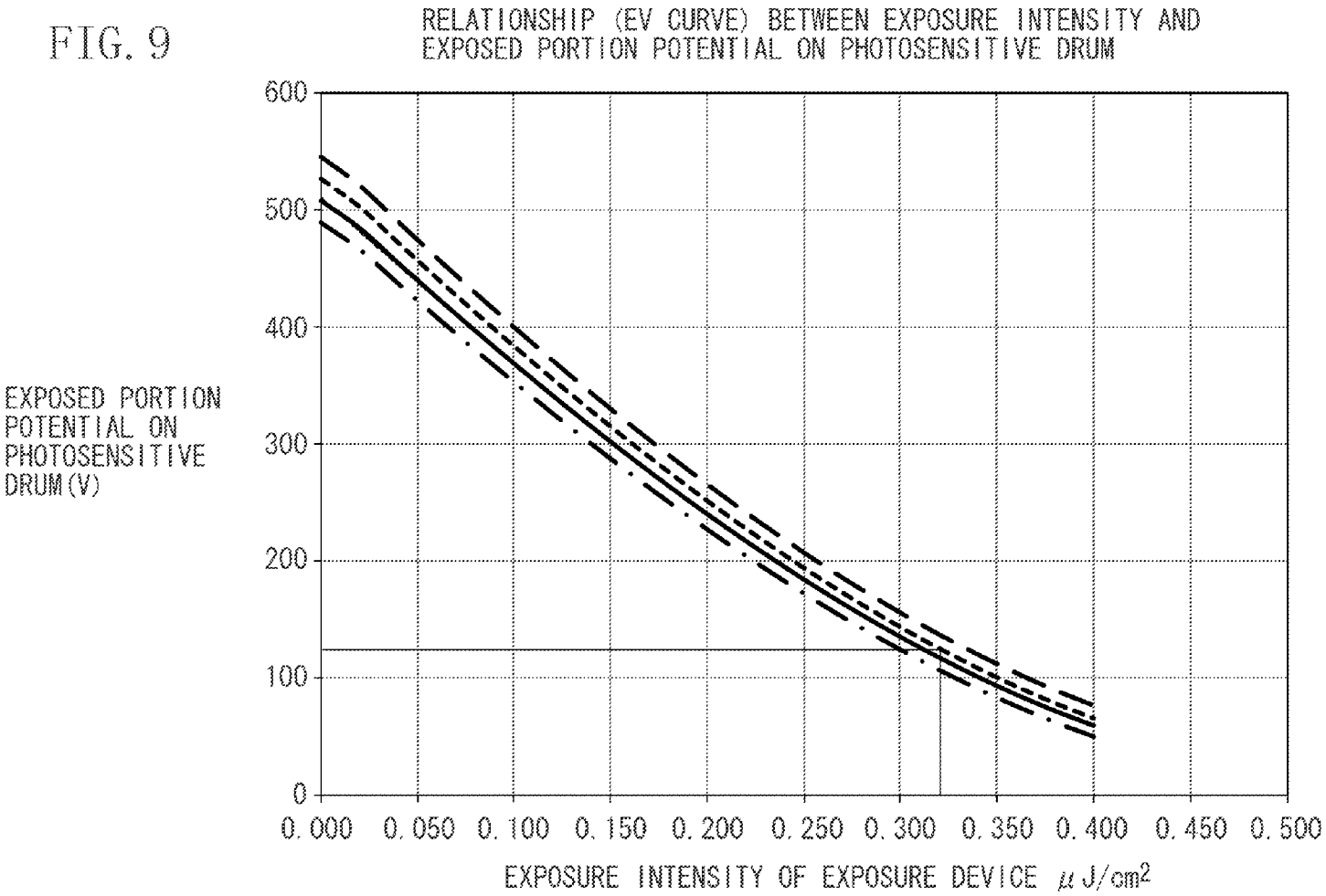
FIG. 9 is a chart illustrating the relationship of an exposed portion potential of a photosensitive drum to an exposure intensity according to the exemplary embodiment of the present invention.

The main body control unit 61 determines the exposure intensity from correlations (EV curves) between the exposure intensity and the exposed portion potential VL at respective film thicknesses which the inventors have experimentally determined in advance. FIG. 9 illustrates the EV curves used in the present exemplary embodiment. FIG. 9 is a chart illustrating the relationship of the exposed portion potential VL of a photosensitive drum 2 to the exposure intensity according to the exemplary embodiment of the present invention. Suppose that the charged portion potential Vd of the black (K) photosensitive drum 2K is −508 V and the exposed portion target potential is −125 V. In such a case, the relationship illustrated in FIG. 9 shows that a light amount of 0.324 μJ/cm$^2$ is needed on the photosensitive drum surface.

The APC circuit performs a laser light amount adjustment (APC) on the exposure device 1 by the foregoing procedure according to the amount of light determined in step S108.

In such a manner, the main body control unit 61 determines conditions of image formation on the photosensitive drums 2. The main body control unit 61 then performs subsequent image formation according to the foregoing description of the operation of the image forming apparatus.

Figure 10:
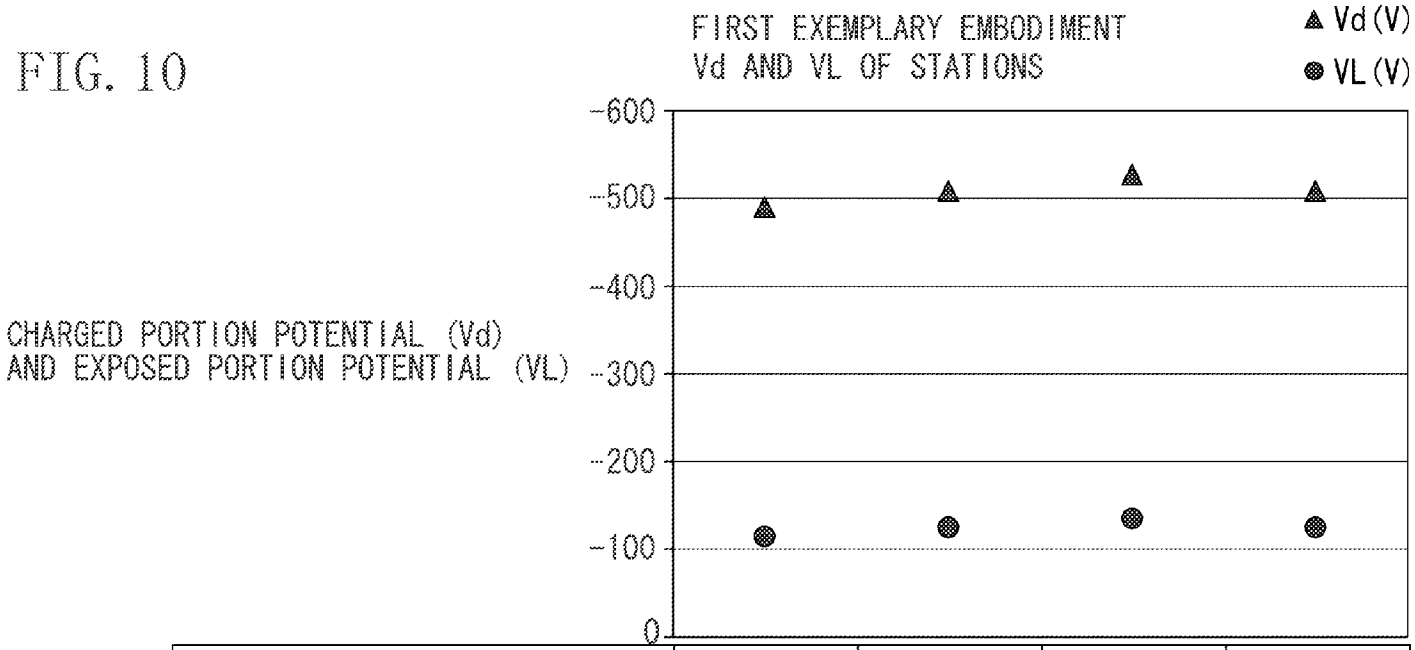
FIG. 10 is a chart illustrating potentials and amounts of exposure of stations according to a first exemplary embodiment of the present invention.
Figure 11:
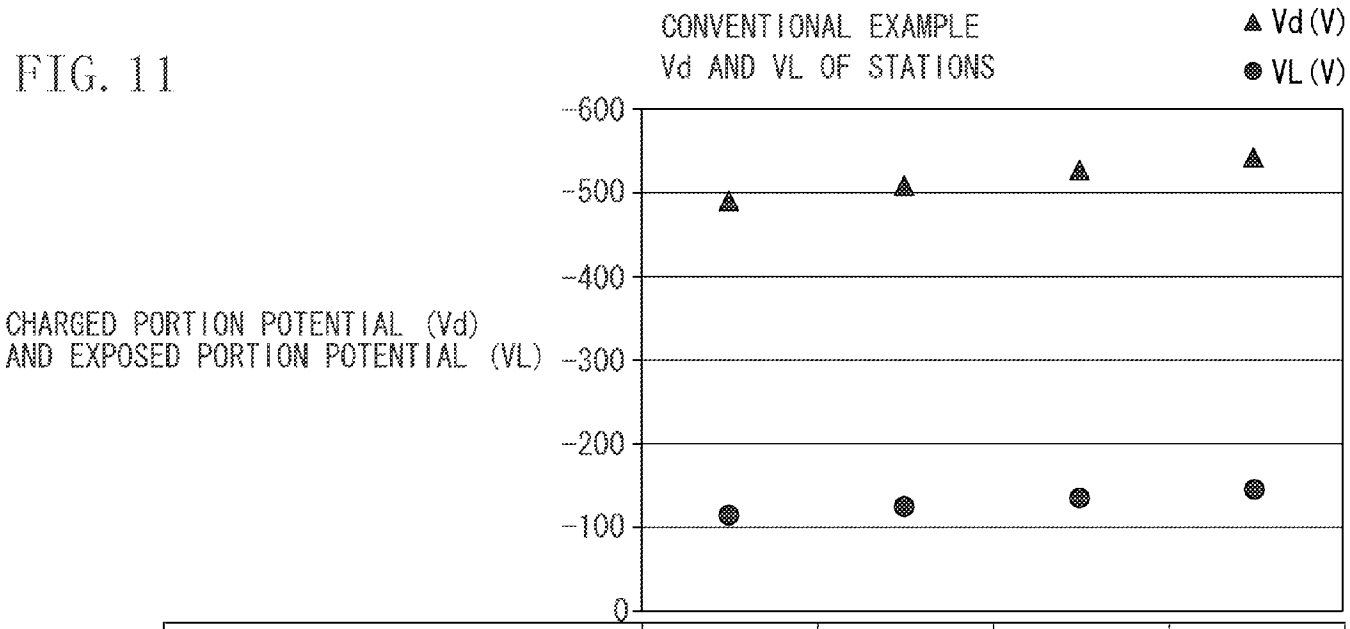
FIG. 11 is a chart illustrating the potentials and the amounts of exposure of stations according to a conventional example.
Figure 12:
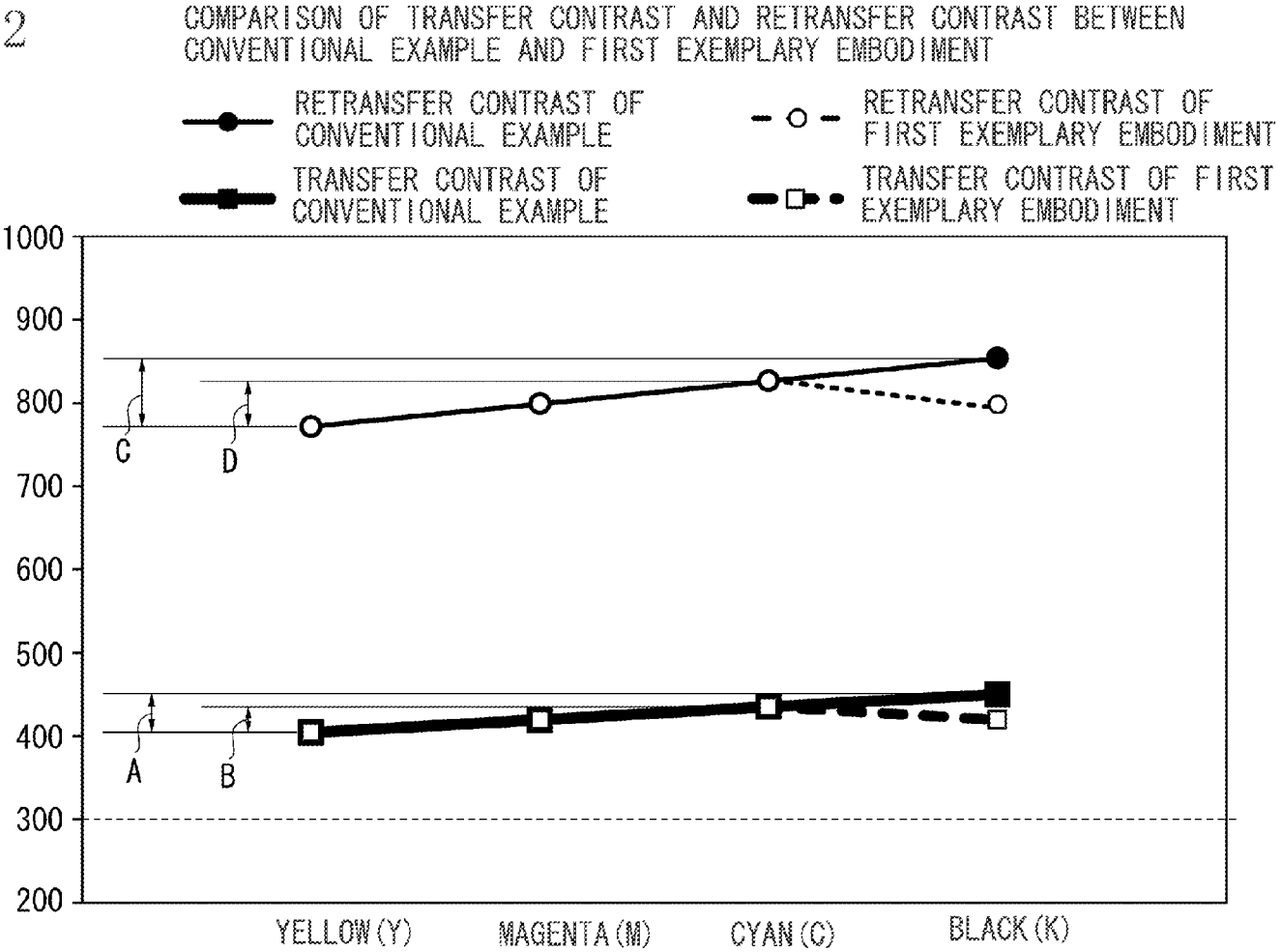
FIG. 12 is a comparison chart illustrating transfer and retransfer contrasts according to the first exemplary embodiment of the present invention and the conventional example.

Referring to FIGS. 10 to 12, effects of the present exemplary embodiment are described in comparison with a conventional technology. FIG. 10 is a chart illustrating the charged portion potential Vd, the exposed portion potential VL, and the amount of exposure of the stations according to the first exemplary embodiment. FIG. 11 is a chart illustrating the charged portion potential Vd and the exposed portion potential VL of stations according to a conventional example.

In the present exemplary embodiment, the charged portion potential Vd and the exposed portion potential VL of the black (K) photosensitive drum 2K are adjusted by adjusting the charging bias and the amount of laser light. A comparison between FIGS. 10 and 11 shows that differences in the charged portion potential Vd and the exposed portion potential VL among the stations according to the present exemplary embodiment are smaller. A transfer contrast is defined by the difference between the transfer bias and the exposed portion potential Vd. A retransfer contrast is defined by the difference between the transfer bias and the charged portion potential VL. In the image forming apparatus using the common primary transfer bias, differences in the transfer contrast and the retransfer contrast among the stations can thus be reduced.

FIG. 12 is a chart illustrating the result of comparison between the first exemplary embodiment and the conventional example about the transfer contrast and the retransfer contrast of the stations. As illustrated in FIG. 12, the difference in the transfer contrast among the stations of the conventional example is 31 V (A in FIG. 12). In the present exemplary embodiment, the difference is reduced to 21 V (B in FIG. 12). As for the retransfer contrast, 55 V (C in FIG. 12) of the conventional example is reduced to 37 V (D in FIG. 12) of the present exemplary embodiment.

As described above, the charging bias (charging voltage) and the amount of exposure of the black (K) station (image forming unit A) are changed based on the film thickness information about the image bearing members of the other yellow (Y), magenta (M), and cyan (C) stations (image forming units B). This suppresses variations in the transfer contrast and the retransfer contrast among the stations.

The characteristics and configuration of the present exemplary embodiment are summarized as follows:

(1) The present exemplary embodiment includes two types of image forming units which share the transfer power supply and use different charging power supplies. One of the two types of image forming units is referred to as an image forming unit A, and the other an image forming unit B.

(2) The image forming unit A is the black station (monochrome image forming unit). The image forming unit B refers to each of the yellow, magenta, and cyan stations (color image forming units). The image forming units A and B share the primary transfer high-voltage power supply 54 as the transfer power supply. The image forming units A and B include different charging power supplies, namely, the charging high-voltage power supply 52 and the charging high-voltage power supply 51, respectively.

(3) The control unit (main body control unit 61) adjusts the charging voltage (charging bias) and the amount of exposure of the image forming unit A based on information (information about film thickness and information about potentials predicted according to the film thickness) about the image bearing members (photosensitive drums 2) of both the image forming units A and B. This can provide different charging voltages (charging biases) for the image forming units A and B. The amounts of exposure for the image bearing members included in the respective image forming units A and B to receive can also be made different.

(4) The use of the different charging voltages can bring the charged portion potential Vd and the exposed portion potential VL of the image bearing member of the image forming unit A closer to those of the image bearing member of the image forming unit B than when the same charging voltage is used.

(5) The present exemplary embodiment includes yellow, magenta, and cyan, three image forming units B in particular. The main body control unit 61 determines averages of the charged portion potentials Vd and the exposed portion potentials VL of the three image forming units B. The main body control unit 61 then performs control to bring the charged portion potential Vd and the exposed portion potential VL of the black station (image forming unit A) closer to the averages of the charged portion potentials Vd and the exposed portion potentials VL of the image forming units B.

More specifically, the image forming apparatus according to the present exemplary embodiment changes the magnitude of the charging bias (charging voltage) for charging at least one of the photosensitive drums 2 to reduce differences in the magnitude of the charged portion potential Vd among the photosensitive drums 2. In the present exemplary embodiment, the image forming apparatus adjusts the magnitude of the charging bias in the black (K) station (image forming unit A). Here, the image forming apparatus adjusts the magnitude of the charging bias so that differences in the charged portion potential Vd among the photosensitive drums 2 become smaller than when the charging bias of the same magnitude as that of the other photosensitive drums 2 is applied to the black (K) photosensitive drum 2K. In other words, the image forming apparatus adjusts the charging bias of the image forming unit A so that the magnitude of the charged portion potential Vd of the black station (image forming unit A) approaches the average value of the magnitudes of the charged portion potentials Vd of the yellow (Y), magenta (M), and cyan (C) stations (image forming units B).

The image forming apparatus determines the charged portion potentials Vd of the photosensitive drums 2 from the layer thicknesses of the respective photosensitive drums 2 detected by the layer thickness detection unit and the magnitudes of the charging biases applied to the charging rollers 7.

The image forming apparatus according to the present exemplary embodiment further adjusts the amount of exposure of at least one of the photosensitive drums 2 to reduce differences in the magnitude of the exposed portion potential VL among the photosensitive drums 2. In the present exemplary embodiment, the image forming apparatus adjusts the amount of exposure of the photosensitive drum 2K included in the black (K) station (image forming unit A). Specifically, the image forming apparatus adjusts the amount of exposure so that differences in the magnitude of the exposed portion potential VL among the photosensitive drums 2 become smaller than when the black (K) photosensitive drum 2K is subjected to a charging bias having the same magnitude as that of the other photosensitive drums 2 and exposed by the same amount of exposure as that of the other photosensitive drums 2. In other words, the image forming apparatus adjusts the amount of exposure so that the magnitude of the exposed portion potential VL of the black station (image forming unit A) approaches the average value of the magnitudes of the exposed portion potentials VL of the yellow (Y), magenta (M), and cyan (C) stations (image forming units B).

The image forming apparatus determines the exposed portion potentials VL of the photosensitive drums 2 from the layer thicknesses of the photosensitive drums 2 detected by the layer thickness detection unit, the magnitudes of the charging biases applied to the charging rollers 7, and the amount of exposure of the exposure unit 1.

With the foregoing configuration, according to the present exemplary embodiment, relative differences in the latent image potentials (charged portion potential Vd and the exposed portion potential VL) among the stations can be reduced even if the transfer power supply (primary transfer high-voltage power supply 54) is shared between the plurality of image forming units (stations). This can ensure compatibility between transferability and retransferability, and enables favorable image formation without complicating the image forming apparatus.

In the present exemplary embodiment, the latent image potentials on the black (K) photosensitive drum 2K are adjusted based on the film thickness information about the yellow (Y), magenta (M), and cyan (C) photosensitive drums 2Y, 2M, and 2C. Alternatively, based on the film thickness information about the black (K) photosensitive drum 2K, the latent image potentials on the photosensitive drums 2Y, 2M, and 2C of the other stations may be adjusted. In either case, relative differences in the latent image potentials (charged portion potential Vd and exposed portion potential VL) among the stations are reduced. This can ensure compatibility between transferability and retransferability, and can provide a favorable image while maintaining the simplification of the image forming apparatus. Such effects are particularly significant for an apparatus in which the transfer power supply is common to the stations, whereby the apparatus can be simplified.

A second exemplary embodiment of the present invention is characterized by a method for calculating the charged portion target potential Vd and the exposed portion target potential VL of the black (K) station. In other respects such as the configuration of the image forming apparatus and a method for controlling an image, the second exemplary embodiment is similar to the first exemplary embodiment. A description thereof will be omitted. The following description deals mainly with differences from the first exemplary embodiment.

Figure 13:
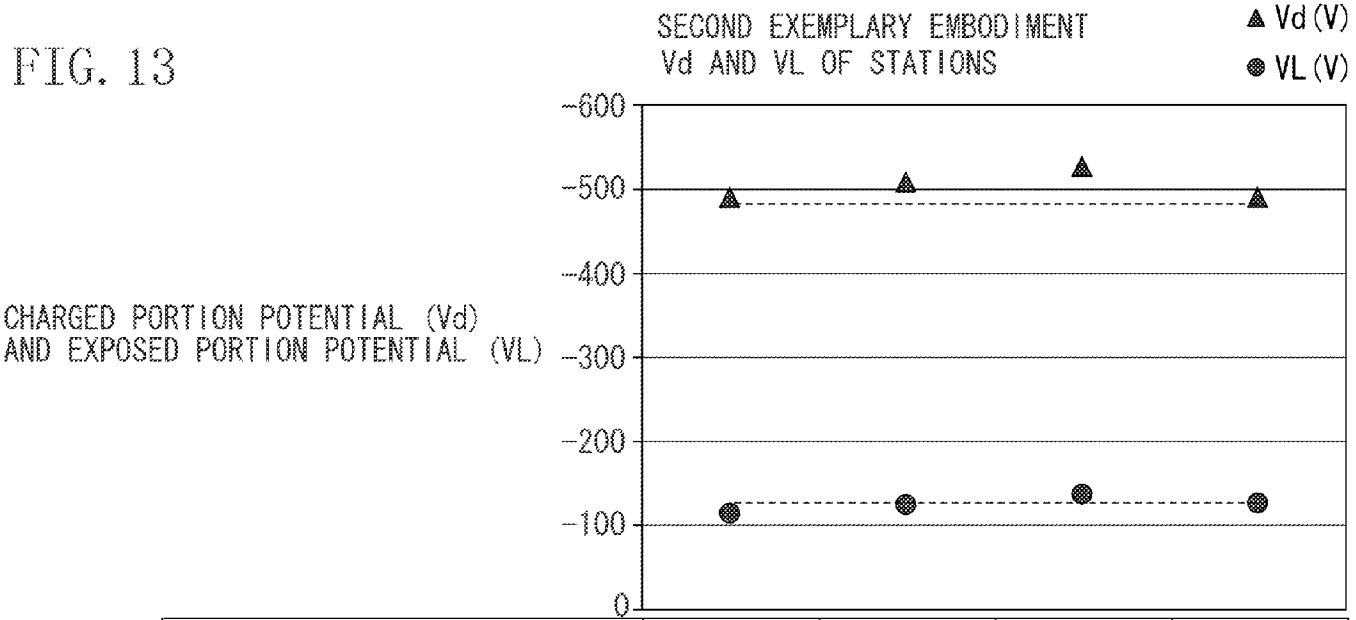
FIG. 13 is a chart illustrating the potentials and the amounts of exposure of stations according to a second exemplary embodiment of the present invention.

FIG. 13 illustrates the charged portion potentials Vd and the exposed portion potentials VL of the stations when the present exemplary embodiment is used. FIG. 13 is a chart illustrating the charged portion potentials Vd, the exposed portion potentials VL, and the amounts of exposure of the stations according to the second exemplary embodiment. Even in the present exemplary embodiment, the charging bias and the exposure intensity are adjusted to adjust the charged portion potential Vd and the exposed portion potential VL of the black (K) station so that differences among the stations decrease. In the second exemplary embodiment, the absolute value of the charging portion potential Vd of the black (K) station is minimized. A detailed description thereof is given below.

As described above, the retransfer phenomenon refers to a phenomenon in which toner transferred to the intermediate transfer belt 9 is reversely transferred to a photosensitive drum 2 in a station lying downstream in the conveyance direction of the intermediate transfer belt 9. The more downstream the station is, the greater the number of colors to be retransferred.

In the present exemplary embodiment, the black (K) station is the most downstream station, i.e., the last one to transfer. If retransfer occurs in the black (K) station, all the toners other than the black (K) toner are affected by the retransfer, with a higher impact on an image. The present exemplary embodiment is intended to address such a problem and reduce the effect of retransfer by minimizing the retransfer contrast of the black (K) station.

A detailed description will be given by using the example illustrated in FIG. 13. In the present exemplary embodiment, like the first exemplary embodiment, photosensitive drums 2 having a film thickness of 16 μm, 14 μm, 12 μm, and 10 μm are mounted on the yellow (Y), magenta (M), cyan (C), and black (K) stations, respectively. In the first exemplary embodiment, the charged portion target potential of the black (K) station (image forming unit A) is set to the average of the charged portion potentials Vd of the yellow (Y), magenta (M), and cyan (C) stations. In the second exemplary embodiment, the charged portion target potential of the black (K) station is set to the charged portion potential Vd of the smallest absolute value among those of the yellow (Y), magenta (M), and cyan (C) stations.

More specifically, in the first exemplary embodiment, the main body control unit 61 performs control to bring the charged portion potential Vd of the black station (image forming unit A) closer to the average of the charged portion potentials Vd of the plurality of color stations (plurality of image forming units B). In the present exemplary embodiment, the main body control unit 61 performs control to bring the charged portion potential Vd of the black station (image forming unit A) closer to the minimum value among the absolute values of the charged portion potentials Vd of the plurality of color stations (plurality of image forming units B) other than the black station. For that purpose, different charging biases (charging voltages) are applied to the black station and the color stations.

In the present exemplary embodiment, the yellow (Y) station has a charged portion potential Vd of −490 V, which has the minimum absolute value. The main body control unit 61 therefore sets the charged portion target potential of the black (K) station to −490 V.

Like the first exemplary embodiment, the main body control unit 61 sets the exposed portion voltage VL of the black (K) station to −125 V, which is the average of the exposed portion voltages VL of the yellow (Y), magenta (M), and cyan (C) stations. Such settings can reduce the retransfer contact of the most downstream station, i.e., the black (K) station, and reduce differences in the transfer contrast and the retransfer contrast among the stations.

In the present exemplary embodiment, the range of change of the charged portion potential Vd is such that document density, fogging, and other developabilities can be secured. A latent image contrast is defined by a difference between the charged portion potential Vd and the exposed portion potential VL. If the latent image contrast decreases, it may become difficult to ensure compatibility between the document density and fogging. In the present exemplary embodiment, the main body control unit 61 sets an upper limit to the range of adjustment of the charged portion target potential so that the latent image contrast will not fall below 340 V.

As described above, in the present exemplary embodiment, the main body control unit 61 changes the charging bias and the amount of exposure of the black (K) photosensitive drum 2K based on the film thickness information about the photosensitive member layers of the other yellow (Y), magenta (M), and cyan (C) photosensitive drums 2Y, 2M, and 2C. The main body control unit 61 thereby suppresses variations in the transfer contrast and the retransfer contrast among the stations. In the present exemplary embodiment, the main body control unit 61 reduces the retransfer contrast of the most downstream station to improve the retransfer of downstream colors and suppresses variations in the transfer contrast and the retransfer contrast. This can provide a favorable image while maintaining the simplification of the image forming apparatus.

In a third exemplary embodiment of the present invention, all the stations include a unit for adjusting the latent image potentials on a photosensitive drum 2. In other respects such as the configuration of the image forming apparatus and the method for controlling an image, the third exemplary embodiment is similar to the first exemplary embodiment. A description thereof will be omitted. The following description deals mainly with differences from the first exemplary embodiment.

Figure 14:
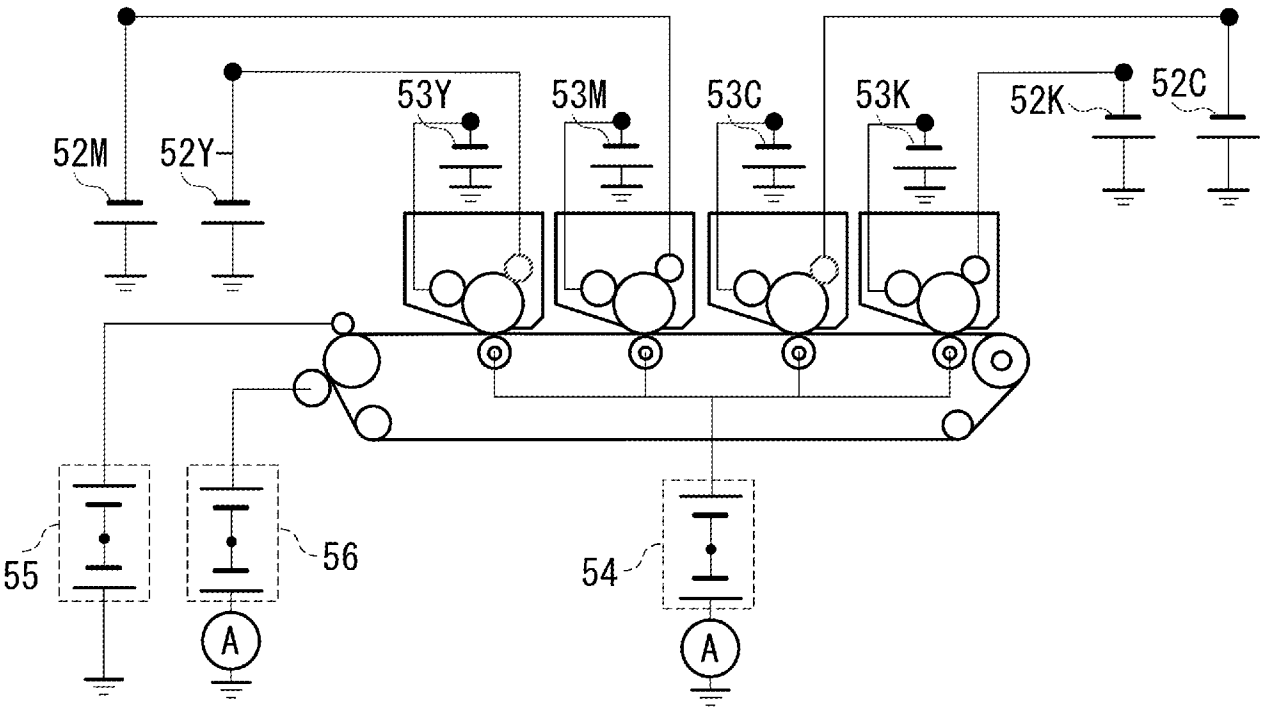
FIG. 14 is a schematic diagram illustrating a configuration of high-voltage bias supply sources of an image forming apparatus according to a third exemplary embodiment of the present invention.

FIG. 14 is a schematic diagram illustrating a confirmation of high-voltage bias supply sources in the image forming apparatus according to the third exemplary embodiment. In the present exemplary embodiment, unlike the first exemplary embodiment, the stations each include a direct-current charging high-voltage power supply (charging power supply) for charging a photosensitive drum 2. The charging biases of the respective stations can thus be set independently (separately). The exposure device 1 is configured to be capable of laser light amount control (APC) on all the stations. To change the target value W1 of the amount of laser light, the CPU 62 in the image forming apparatus issues an instruction to change the reference voltage Vref, and the APC circuit performs the APC operation by the foregoing procedure so that an image can be formed with the target amount of light. With such a configuration, the latent image potentials (charged portion potential Vd and exposed portion potential VL) on the photosensitive drums 2 of all the stations can be independently adjusted.

Figure 15:
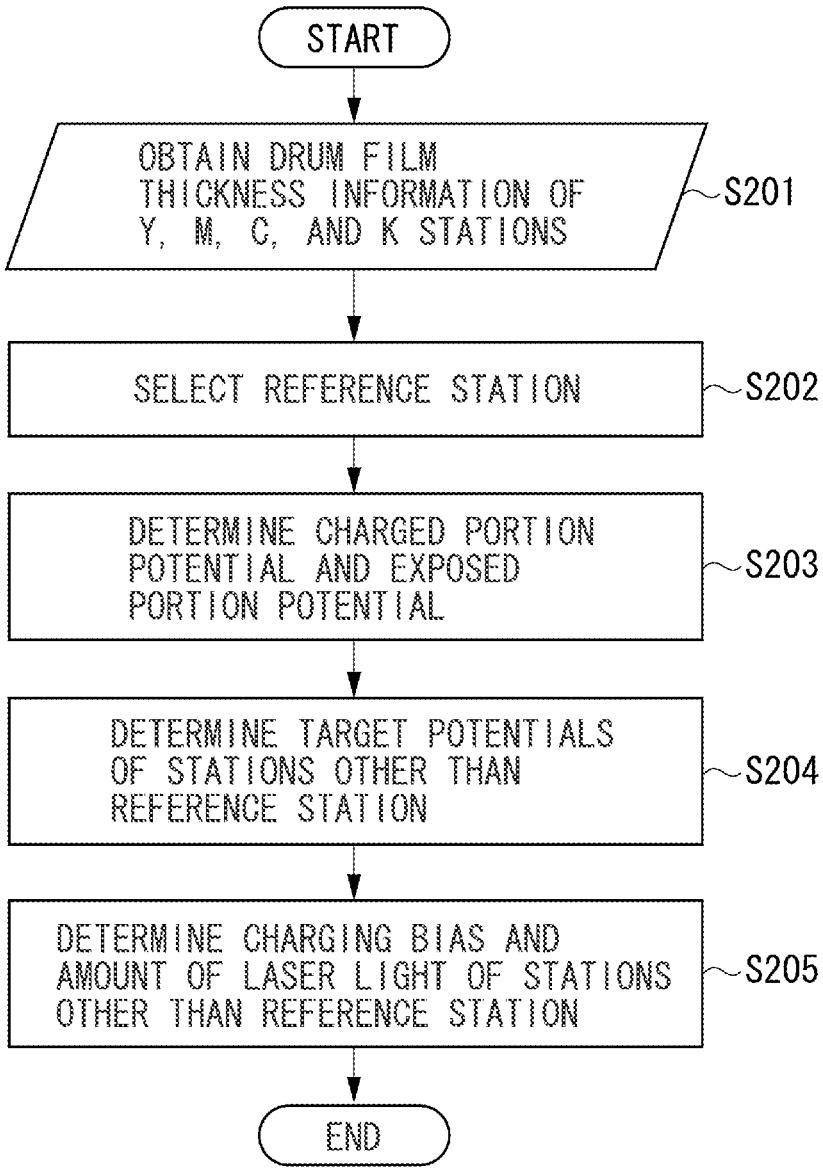
FIG. 15 is a flowchart illustrating a control flow of image forming units according to the third exemplary embodiment of the present invention.

A flow of image formation according to the third exemplary embodiment will be described with reference to FIG. 15. FIG. 15 is a flowchart illustrating a control flow of the image forming units according to the present exemplary embodiment. In step S201, the main body control unit 61 receives an instruction to start image formation, and obtains drum film thickness information of the yellow (Y), magenta (M), cyan (C), and black (K) stations from the memories 71 in the process cartridges C. In step S202, the main body control unit 61 selects a station having the largest photosensitive drum film thickness as a reference station based on the obtained drum film thickness information. In step S203, the main body control unit 61 determines the charged portion potential Vd and exposed portion potential VL of the reference station selected in step S202 for a case where a latent image is formed on the condition that the charging bias set to a reference voltage of −1029 V and the amount of laser light on the photosensitive drum surface is 0.311 μJ/cm$^2$. The method for estimating the charged portion potential Vd and the exposed portion voltage VL is the same as described in the first exemplary embodiment.

In step S204, the main body control unit 61 determines the target potentials Vd and VL of the other three stations to be the charged portion potential Vd and the exposed portion potential VL determined in step S203. In step S205, the main body control unit 61 determines the charging bias and the amount of laser light of the other three stations to achieve the target potentials Vd and VL determined in step S204. The method for estimating the charged portion potentials Vd and the exposed portion voltages VL is the same as described in the first exemplary embodiment.

Referring to FIG. 16, effects of the third exemplary embodiment will be described in comparison with a conventional example. FIG. 16 is a chart illustrating the potentials of the stations according to the third exemplary embodiment and the conventional example. Suppose that photosensitive drums 2 having a film thickness of 13 μm, 10 μm, 16 μm, and 13 μm are mounted on the yellow (Y), magenta (M), cyan (C), and black (K) stations, respectively. The cyan (C) photosensitive drum 2C has the largest film thickness of 16 μm. The main body control unit 61 thus selects the cyan (C) station as the reference station. Assuming that the charging bias is the reference voltage of −1029 V and the amount of laser light on the photosensitive drum surface is a reference light amount of 0.311 μJ/cm$^2$, the charged portion potential Vd and the exposed portion potential VL of the reference station are −490 V and −114 V, respectively. Such potentials Vd and VL are used as the target potentials of the other stations. The method for determining Vd and VL is the same as described in the first exemplary embodiment.

In the present exemplary embodiment, the charging bias and the amount of laser light of all the stations can be independently changed. Each station can be adjusted to the foregoing target potentials by the procedure described in the first exemplary embodiment.

The exemplary embodiment has dealt with the case where the station having the largest photosensitive drum film thickness is selected as the reference station. However, other stations may be used as the reference station. Even in such a case, relative differences in the latent image potentials (charged portion potential Vd and exposed portion potential VL) among the stations can be reduced to improve compatibility between transferability and retransferability and obtain a favorable image while maintaining the simplification of the image forming apparatus.

In the present exemplary embodiment, the station including the photosensitive drum 2 having the thickest photosensitive member layer is selected as the reference station. This can reduce the maximum value of the charging bias to be applied. FIG. 16 illustrates the charging biases of the stations when the cyan station having the largest photosensitive drum film thickness is selected as the reference station and when the magenta station having the smallest photosensitive drum film thickness is selected as the reference station. As can be seen from FIG. 16, if the cyan (C) station is selected as the reference station, the maximum value of the charging bias is −1029 V. If the magenta (M) station having the smallest photosensitive drum film thickness is selected as the reference station, the maximum value of the charging bias is −1084 V. In such a manner, the upper limit value of the charging bias can be suppressed to provide an additional effect of reducing the risk of developing pinholes in the photosensitive drums 2.

As has been described, according to the present exemplary embodiment, the main body control unit 61 selects one of the yellow (Y), magenta (M), cyan (C), and black (K) stations as a reference station, and the photosensitive drum 2 of that station as a reference image bearing member. With the charged portion potential Vd and the exposed portion potential VL of the reference image bearing member as target potentials, the main body control unit 61 adjusts the potentials of the other stations, i.e., the image bearing members other than the reference image bearing member. This can suppress variations in the transfer contrast and the retransfer contrast and ensure compatibility between transfer and retransfer. Selecting the station having the largest film thickness as the reference station can reduce the charging biases, in which case the photosensitive drums 2 are expected to improve in leak resistance.

In the present exemplary embodiment, the station serving as the reference station among all the stations (yellow, magenta, cyan, and black) is referred to as an image forming unit B (reference image forming unit). The other stations are referred to as image forming units A.

The image forming units A and B share the transfer power supply (primary transfer high-voltage power supply 54) and include different charging power supplies (see charging high-voltage power supplies 52Y, 52M, 52C, and 52K in FIG. 14) regardless of which station is selected as the image forming unit B.

The control unit (main body control unit 61) can thus make the charging voltages and the amounts of exposure of the image forming units A different from those of the image forming unit B. Consequently, even if the image bearing members (photosensitive drums 2) of the image forming units A and B have different states (film thicknesses), the main body control unit 61 can control the potentials of the respective image bearing members to similar values. In other words, the main body control unit 61 can control the potentials (exposed portion potential Vd and charged portion potential VL) of the image bearing members of all the image forming units to the potentials of the reference image bearing member (the potentials of the image bearing member of the image forming unit B).

The configurations of the foregoing exemplary embodiments may be combined with each other as much as possible.

The effects of the foregoing exemplary embodiments (first to third exemplary embodiments) may be summarized as follows: Variations in the charged portion potential Vd and the exposed portion potential VL among the plurality of image bearing members can be suppressed to ensure compatibility between transferability and retransferability.

Following exemplary embodiments will dealt with a configuration where a plurality of stations (image forming units) share not only a transfer power supply but a developing power supply to further simplify the power supply configuration of an image forming apparatus.

Figure 17A:
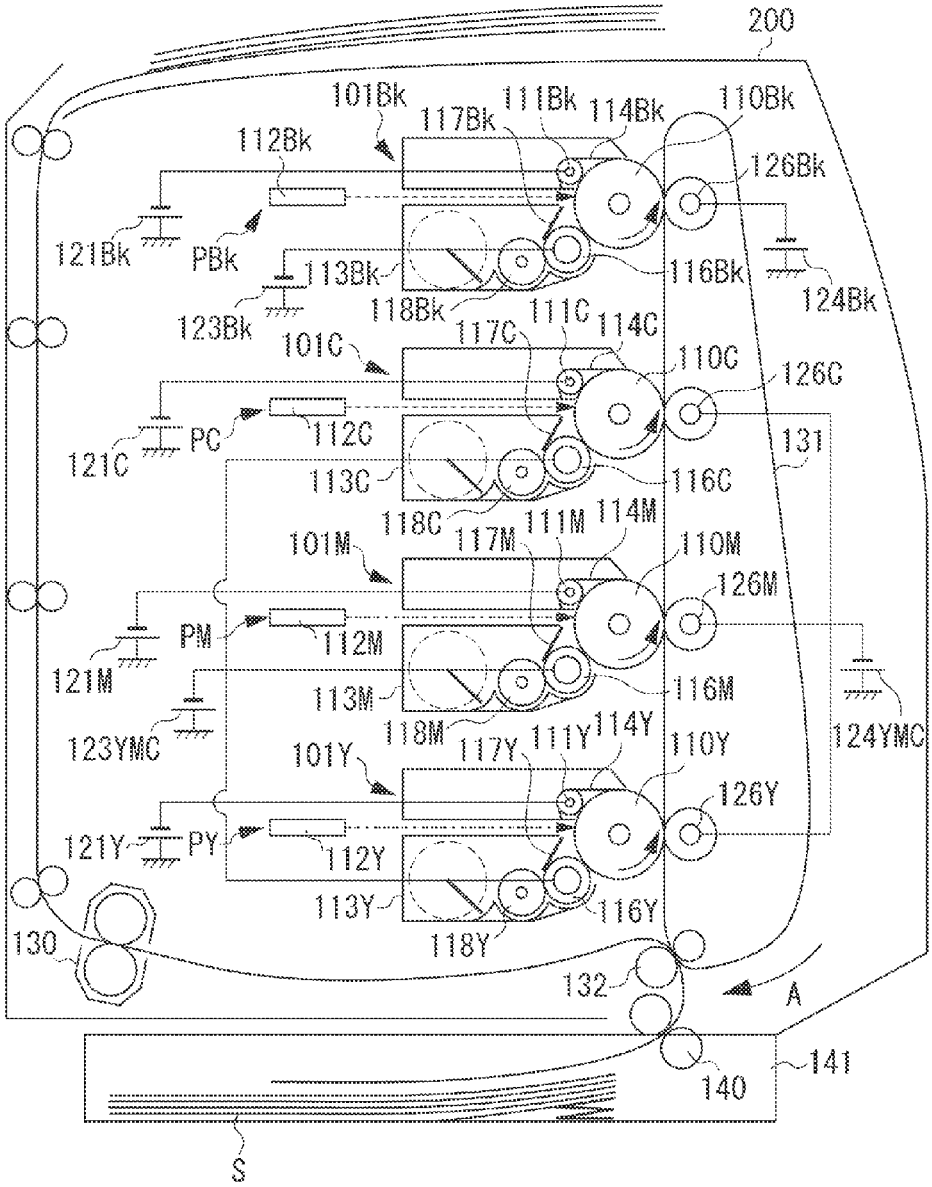
FIG. 17A is a schematic diagram illustrating a configuration of an image forming apparatus according to an exemplary embodiment of the present invention.
Figure 17B:
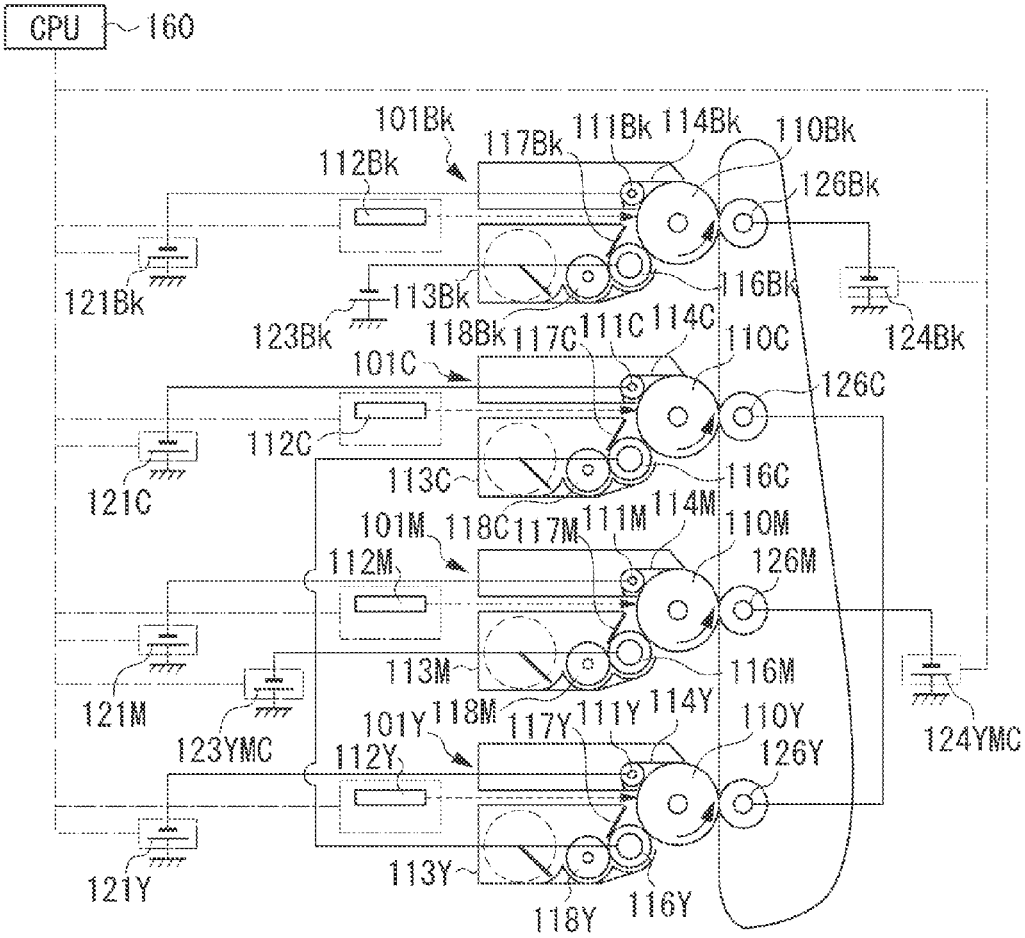
FIG. 17B is a schematic diagram illustrating a configuration of essential parts for describing exposure devices of the image forming apparatus according to the exemplary embodiment of the present invention and modes of application of developing biases, charging biases, and transfer biases.

FIGS. 17A and 17B illustrate schematic cross sections of an image forming apparatus 200 according to a fourth exemplary embodiment.

The image forming apparatus 200 includes an image forming apparatus main body 102, which is connected with an external host device, such as a personal computer, for communication. According to an image information signal from the external host apparatus, the image forming apparatus 200 can form an image on a transfer material by using an electrophotographic process, and output the resultant. Examples of the transfer material include recording paper, an overhead projector (OHP) sheet, and cloth.

The image forming apparatus 200 includes first to fourth image forming units (image forming stations) PY, PM, PC, and PBk, which form yellow (Y), magenta (M), cyan (C), and black (Bk) images, respectively. The four image forming units PY, PM, PC, and PBk are arranged in parallel along an intermediate transfer member (intermediate transfer belt) 131 serving as a transfer member (transfer material). The intermediate transfer belt 131 moves to circulate in the direction of the arrow A in FIG. 17A. More specifically, the yellow, magenta, cyan, and black image forming units PY, PM, PC, and PBk are vertically arranged in a row in order from the bottom in FIG. 17A. The image forming units PY, PM, PC, and PBk are configured to transfer toner images (developer images) to the intermediate transfer belt 131 serving as a transfer member, whereby a full color image can be formed.

Figure 18:
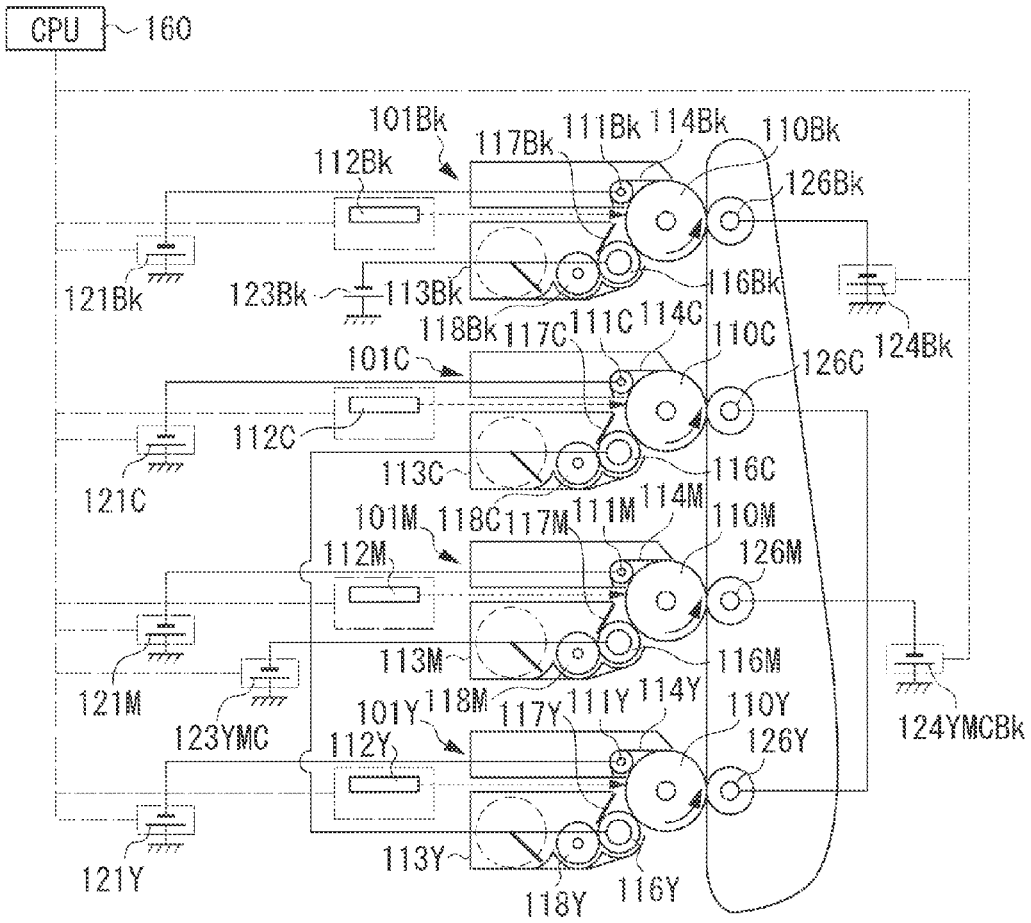
FIG. 18 is a schematic diagram illustrating an image forming apparatus according to an exemplary embodiment of the present invention.

FIG. 18 illustrates the image forming units PY, PM, PC, and PBk in more detail. In the present exemplary embodiment, the image forming units PY, PM, PC, and PBk of respective colors have substantially the same configuration except in that images are formed in different colors. The suffixes Y, M, C, and Bk are intended to indicate elements belonging to the image forming units of the respective colors. Hereinafter, the image forming units PY, PM, PC, and PBk will be described in a comprehensive manner by omitting the suffixes Y, M, C, and Bk unless a distinction needs to be made.

Each image forming unit includes a drum-shaped electrophotographic photosensitive member (photosensitive drum) 110 as an image bearing member, which bears an image (developer image, toner image).

The photosensitive drum 110 includes a cylindrical aluminum core. For example, an OPC photosensitive layer (hereinafter, referred to as a photosensitive layer) having a negative charging polarity is formed on the surface of the aluminum core. The photosensitive layer includes a charge carrier generation layer (hereinafter, referred to as a CG layer) and a charge carrier transport layer (hereinafter, referred to as a CT layer). In the present exemplary embodiment, the CT layer in an initial state has a film thickness of 17 μm. The photosensitive drum 110 continues being used until the CT layer is worn to approximately 10 μm.

A charging roller 111 serving as a charging device is driven to rotate by the photosensitive drum 110. The charging roller 111 uniformly charges the surface of the photosensitive drum 110 with a charged portion potential Vd. An exposure device 112 serving as an exposure unit forms an electrostatic latent image on the surface of the photosensitive drum 110 by performing scanning exposure using a light signal according to image signal information. A developing device 113 serving as a developing unit adheres toner serving as a developer to the electrostatic latent image, whereby the electrostatic latent image is visualized as a developer image (toner image).

For example, when forming a full color image, the image forming units form respective color toner images on the photosensitive drums 110. A predetermined primary transfer bias is applied to primary transfer rollers 126 serving as primary transfer units (transfer devices). As a result, the toner images are successively superposed and transferred to the intermediate transfer belt 131 in primary transfer portions of the respective image forming units where the photosensitive drum 110 and the primary transfer rollers 126 are opposed to each other. In such a manner, a full color image is formed on the intermediate transfer belt 131.

Next, a predetermined secondary transfer bias is applied to a secondary transfer roller 132 serving as a secondary transfer unit. As a result, the toner image on the intermediate transfer belt 131 is secondarily transferred to a transfer material S. The transfer material S is supplied from a transfer material supply unit 140 to a secondary transfer portion where the intermediate transfer belt 131 and the secondary transfer roller 132 are opposed to each other, in synchronization with the image formation on the intermediate transfer belt 131. The transfer material supply unit 140 includes a transfer material cassette 141 and a transfer material supply roller 142 serving as a conveyance unit.

The transfer material S with the transferred toner image is conveyed to a fixing device 130. The fixing device 130 fixes the unfixed image to the transfer material S. The image-fixed transfer material S is discharged to a discharge tray 135, and the image formation ends.

At the time of primary transfer, some toner may remain untransferred on each photosensitive drum 110. Such remaining toner (primary transfer residual toner) is collected into a waste toner container by a cleaning device 114 serving as an image bearing member cleaning unit, whereby the surface of the photosensitive drum 110 is cleaned. The cleaning device 114 includes a cleaning blade serving as a cleaning member and the waste toner container. At the time of secondary transfer, some toner may remain untransferred on the intermediate transfer belt 131. Such remaining toner (secondary transfer residual toner) is scraped off by an intermediate transfer member cleaning unit (not illustrated), whereby the surface of the intermediate transfer belt 131 is cleaned. The intermediate transfer member cleaning unit is arranged to be detachably attachable to the intermediate transfer belt 131.

In the present exemplary embodiment, the photosensitive drum 110 has a diameter of 30 mm. The photosensitive drum 110 is driven to rotate in the direction of the arrow in FIGS. 17A, 17B, and 18 at a circumferential speed of 100 mm/sec. The surface of the photosensitive drum 110 is uniformly charged by the charging roller 111.

A charging high-voltage power supply (charging power supply) that is a high-voltage power supply applies a direct-current voltage of −1100 V to the charging roller 111, whereby the surface of the photosensitive drum 110 is uniformly charged with a charged portion potential Vd of approximately −550 V. The charging devices (charging rollers 111) corresponding to the yellow (Y), magenta (M), cyan (C), and black (Bk) developing devices are provided with charging high-voltage power supplies 121Y, 121M, 121C, and 121Bk, respectively.

In the present exemplary embodiment, the charging bias (charging voltage) applied to each charging roller 111 is a direct-current bias. However, a bias including a direct-current component and an alternating-current component superposed thereon may be used as the charging bias.

According to the direct-current (DC) charging roller method, the surface potential (charged portion potential Vd) of the charged photosensitive drum 110 varies due to various reasons. Specifically, the charged portion potential Vd can vary depending on the voltage applied to the charging roller 111, the environment in which the image forming apparatus 200 is placed, and a discharge start voltage Vth of the photosensitive drum 110 which varies with the film thickness of the CT layer.

The discharge start voltage Vth increases by approximately 50 V if the environment changes from high temperature and high humidity (30° C. in temperature and 80% in relative humidity) to low temperature and low humidity (15° C. in temperature and 10% in relative humidity). The discharge start voltage Vth decreases by approximately 50 V with a change in the film thickness of the CT layer (from 15 μm to 10 μm).

The exposure device 112 is capable of adjusting the amount of laser light to emit by pulse width modulation (PWM) control, which includes driving the exposure device 112 based on an ON/OFF signal (PWM signal). The exposure device 112 can thus adjust the amount of laser light to emit according to image data input to the image forming apparatus 200 and the state of the photosensitive drum 110. The exposure device 112 can perform scanning exposure on the surface of the photosensitive drum 110 to form an electrostatic latent image on the surface of the photosensitive drum 110 with a constant exposed portion potential Vd of approximately −180 V. While the present exemplary embodiment deals with the case of adjusting the amount of laser light to emit by PWM control, the exposure device 112 may adjust the intensity of laser light to emit.

The developing device 113 has generally the same configuration as described above. The developing device 113 reversely develops the electrostatic latent image on the photosensitive drum 110 by a constant developing method, using toner having the same charging polarity (in the present exemplary embodiment, negative polarity) as that of the photosensitive drum 110.

More specifically, the developing device 113 includes a developing container (developing device main body) which stores negatively-chargeable nonmagnetic toner (mono-component toner) or mono-component developer as a developer. The developing container includes a developing roller 116 serving as a developer bearing member, a developing blade 117 serving as a developer regulating member, a toner supply roller 118 serving as a developer supply member, and an agitation blade serving as a developer agitation and conveyance unit.

In the present exemplary embodiment, the developing roller 116 includes a core and an elastic layer formed thereon. The core is made of a metal such as aluminum and an aluminum alloy. The elastic layer includes a base layer and a surface layer thereon. The developing roller 116 has an outer diameter of 16 mm. The base layer of the elastic layer is made of a silicone or other rubber. The surface layer is made of ether urethane or nylon. It will be understood that the elastic layer is not limited to such materials. The base layer may be made of sponge or other foam material. A rubber elastic layer may be formed as the surface layer. The developing roller 116 showed a resistance of 1 MΩ when the developing roller 116 was pressed against a ϕ30 metal cylinder with a total pressure of 1 kg and 50 V was applied thereto. In the present exemplary embodiment, the developing roller 116 is driven to rotate at a circumferential speed of 160 mm/sec by a drive unit (not illustrated).

At the time of development, the developing roller 116 comes into contact with the surface of the photosensitive drum 110. In the contact portion (developing portion), the electrostatic latent image formed on the photosensitive drum 110 is visualized as a toner image by toner borne on the developing roller 116. As will be described in detail below, a negative direct-current voltage (developing bias voltage) of approximately −350 V to −500 V is applied to the development roller 116 from a high-voltage supply (developing bias power supply, developing power supply) 123YMC or 123Bk serving as a developing voltage application unit. As a result, the negatively charged toner is transferred from the developing roller 116 to the electrostatic latent image formed on the photosensitive drum 110.

In the present exemplary embodiment, the image forming apparatus 200 has a multiple color mode (color mode) for forming an image in full colors (yellow, magenta, cyan, and black) and a monochrome mode (mono mode) for imaging an image in monochrome (black). In the color mode, the photosensitive drums 110 of the respective colors are put into contact with the intermediate transfer member, and driven to perform development and transfer in yellow, magenta, cyan, and black in order, whereby a color image is formed. When forming an image in the mono mode, only the black photosensitive drum 110Bk is put into contact with the intermediate transfer member, and driven to perform development and transfer. This can suppress wear of the photosensitive drums 110, charging devices (charging rollers 111), and developing devices 113 of the unused colors as compared to the color mode.

In the present exemplary embodiment, a common high-voltage power supply (developing power supply) 123YMC is used to apply voltages to the yellow (Y), magenta (M), and cyan (C) developing rollers 116Y, 116M, and 116C which are used in the color mode for forming a color image. The yellow (Y), magenta (M), and cyan (C) developing rollers 116Y, 116M, and 116C are connected in parallel to the high-voltage power supply (developing power supply) 123YMC. Consequently, the high-voltage power supply 123YMC applies the same developing bias voltage (developing voltage) to the yellow (Y), magenta (M), and cyan (C) developing rollers 116Y, 116M, and 116C. When forming an image in the mono mode (monochrome mode) for forming a monochrome image, the image forming apparatus 200 uses only the monochrome black (Bk) developing device 116Bk. A high-voltage power supply 123Bk that applies a voltage to the black (Bk) developing device 116Bk is thus separated from the high-voltage power supply 123YMC.

In a product that does not take the mono mode into consideration, a common high-voltage power supply may be used to apply voltages to all the yellow (Y), magenta (M), cyan (C), and black (Bk) developing rollers 116Y, 116M, 116C, and 116Bk. A bias including a direct-current component and an alternating-current component superposed thereon may be used as the developing bias voltage(s). The direct-current voltages output by the developing bias power supplies 123YMC and 123Bk are variable.

As described above, the inline image forming apparatus 200 includes the four developing devices 113. To adjust the densities of the respective colors, the two developing bias power supplies 123YMC and 123Bk serving as voltage application units are provided for the developing devices 113.

The developing roller 117 serving as a developer regulating member for regulating the amount of the developer borne on the developing roller 116 is supported above the developing roller 116 by the developing container. The developing blade 117 is one of developing auxiliary members. The development blade 117 is arranged so that a portion near the extremity of its free end makes a surface contact with the outer periphery of the developing roller 116.

In the present exemplary embodiment, the direction of contact of the developing blade 117 is in a counter direction, where the extremity lies upstream of the contact portion in the direction of rotation of the developing roller 116. In the present exemplary embodiment, the developing blade 117 includes a 0.1-mm-thick phosphor bronze plate having spring elasticity, which is in contact with the surface of the developing roller 116 with a predetermined line pressure. The pressing force of the developing blade 117 against the developing roller 116 is maintained for triboelectrification, whereby the developing blade 117 provides chargeability for the negatively-chargeable toner.

As will be described in detail below, a high-voltage power supply (blade bias power supply, first auxiliary member power supply) serving as a regulating member voltage application unit applies a direct-current voltage (blade bias) to the developing blade 117. The blade bias has a potential difference of approximately −100 to −200 V from the developing bias. The application of the blade bias stabilizes the coating amount of toner. The image forming apparatus 200 includes four blade bias power supplies (not illustrated). The power supplies apply respective bias voltage values to the developing blades 117 of the developing devices 113Y, 113M, 113C, and 113Bk in the image forming units PY, PM, PC, and PBk of yellow, magenta, cyan, and black, four colors. The bias voltage values that the blade bias power supplies apply to the developing blades 117 of the developing devices 113 are variable. While the present exemplary embodiment deals with the case where the image forming apparatus 200 includes the four blade bias power supplies, the blade bias power supplies of the yellow (Y), magenta (M), and cyan (C) developing devices 113Y, 113M, and 113C may be made common like the developing bias power supply 123YMC. Even the blade bias power supply of the black (Bk) developing device 113Bk may also be made common to integrate the high-voltage power supplies into one.

As described above, in the present exemplary embodiment, the developing biases and the blade biases have a negative polarity. For the sake of convenience, the magnitudes of the developing bias values and the blade bias values are compared and described in absolute values. For example, large development bias values and large blade bias values are large in terms of absolute values. In the present exemplary embodiment, such values refer to high values of negative polarity.

The toner supply roller 118 may have a sponge structure or a fur brush structure including a core and rayon, nylon, or other fibers planted therein. In view of supplying toner to the developing roller 116 and removing undeveloped residual toner on the developing roller 116, the present exemplary embodiment uses a 16-mm-diameter elastic roller including a core 118*a* and urethane foam 118*b* formed thereon. Like the developing blade 117, the toner supply roller 118 is one of the developing auxiliary members.

A high-voltage power supply (supply roller bias power supply, second auxiliary member power supply) serving as a supply roller voltage application unit applies a direct-current voltage (supply roller bias) to the supply roller 118. The supply roller bias has a potential difference of approximately −200 to +200 V from the developing bias. The application of the supply roller bias stabilizes the supply and removal of toner to/from the developing roller 116 by the toner supply roller 118. The image forming apparatus 200 includes four supply roller bias power supplies (not illustrated). The supply roller bias power supplies apply respective bias voltage values to the supply rollers 118 of the developing devices 113Y, 113M, 113C, and 113Bk in the image forming units PY, PM, PC, and PBk of yellow, magenta, cyan, and black, four colors. The bias voltage values applied to the supply rollers 118 are variable. While the present exemplary embodiment deals with the case where the image forming apparatus 200 includes the four supply roller bias power supplies, the supply roller bias power supplies of the yellow (Y), magenta (M), and cyan (C) image forming units may be made common like the developing bias power supply 123YMC. Even the supply roller bias power supply of the black (Bk) image forming unit may be made common to integrate the high-voltage power supplies into one.

The supply roller 118 including the elastic roller is in contact with the developing roller 116. In the developing process, the supply roller 118 is driven to rotate at a circumferential speed of 100 mm/sec so that the supply roller 118 moves in a direction opposite to that of the developing roller 116 in the contact portion with the developing roller 116. The amount of intrusion of the supply roller 118 into the developing roller 116 is 1.5 mm.

As described above, the toner images on the surfaces of the photosensitive drums 110 are transferred to the intermediate transfer belt 131. For the purpose of the transfer, primary transfer bias power supplies 124YMC and 124Bk serving as primary transfer voltage application units apply primary transfer bias voltages (transfer voltages) to the transfer rollers 126Y, 126M, 126C, and 126Bk. A secondary transfer bias power supply (not illustrated) serving as a secondary transfer voltage application unit applies a secondary transfer bias voltage to the secondary transfer roller 132. The secondary transfer roller 132 transfers the toner images to the transfer material S, and then the toner images are fixed.

As will be described in detail below, the high-voltage power supplies (primary transfer bias power supplies, transfer power supplies) 124YMC and 124Bk serving as the primary transfer voltage application units apply a direct-current positive voltage (transfer bias voltage) of approximately 4000 V to 0 V to the transfer rollers 126. The negatively charged toner images are thereby moved (transferred) from the photosensitive drums 110 to the intermediate transfer belt 131.

In the present exemplary embodiment, in consideration of the mono mode for printing only in black, the common high-voltage power supply 124YMC is used to apply voltages to the yellow (Y), magenta (M), and cyan (C) transfer rollers 126. Depending on the specifications of the product, a common high-voltage power supply may be used to apply voltages to all the yellow (Y), magenta (M), cyan (C), and black (Bk) transfer rollers 126. The direct-current voltages output by the transfer bias power supplies 124YMC and 124Bk are variable.

If next image data is successively input to the image forming apparatus 200, the image forming apparatus 200 repeats the next image forming operation without stopping the rotations of the photosensitive drums 110, the developing rollers 116, and the toner supply rollers 118 and with the developing rollers 116 at the same potential(s).

In the present exemplary embodiment, the developing devices 113, the photosensitive drums 110 which are driven to rotate, the charging rollers 111 which uniformly charge the surfaces of the photosensitive drums 110, and the cleaning devices 114 are integrated with frame members to constitute process cartridges 101. The process cartridges 101Y, 101M, 101C, and 101Bk of respective colors are detachably attachable to the image forming apparatus main body 102 via mounting units (not illustrated) included in the image forming apparatus main body 102. In the present exemplary embodiment, the process cartridges 101 each include the photosensitive drum 110, the charging roller 111, and the waste toner container which supports the cleaning blade 117. The waste toner container is integrally connected with the developing container to constitute the process cartridge 101. The developing container supports the developing roller 116, the developing blade 117, the toner supply roller 118, and the agitation blade.

The configuration of the process cartridges 101 is not limited thereto. For example, the developing devices 113 may be fixed and installed alone on the image forming apparatus main body 102. In such a case, the process cartridges 101 are each configured as a cartridge integrally including at least one of a photosensitive member serving as an image bearing member, a charging unit that charges the photosensitive member, a developing unit that supplies a developer to the photosensitive member, and a cleaning unit that cleans the photosensitive member. Such cartridges may be detachably attached to the image forming apparatus main body 102. Alternatively, the developing devices 113 alone may be configured as cartridges (developing cartridges) detachably attachable to the image forming apparatus main body 102.

In the present exemplary embodiment, when the process cartridges 101 are mounted on the image forming apparatus main body 102, drive units (not illustrated) included in the image forming apparatus main body 102 are connected to drive transmission units of the process cartridges 101. As a result, the photosensitive drums 110, the developing devices 113, and the charging rollers 111 become drivable. The power supplies that apply voltages to the charging rollers 111, the developing rollers 116, and the developing blades 117 are arranged on the image forming apparatus main body 102 side. When the process cartridges 101 are mounted on the image forming apparatus main body 102, such power supplies are electrically connected to the charging rollers 111, the developing rollers 116, and the developing blades 117 via contacts arranged on the process cartridge 101 side and ones arranged on the image forming apparatus main body 102 side.

In the present exemplary embodiment, the image forming apparatus main body 102 includes a CPU 160 (FIG. 18). The CPU 160 serves as a control unit that controls operations of the image forming apparatus 200 in a comprehensive manner. The CPU 160 controls the power supplies included in the image forming apparatus 200.

More specifically, the CPU 160 controls the blade bias power supplies, the supply roller bias power supplies, the developing bias power supplies, the primary transfer bias power supplies, the secondary transfer bias power supply, and the charging power supplies.

In the present exemplary embodiment, the CPU 160 performs image quality stabilization control to determine setting values of the charging biases, the developing biases, the transfer biases, and the amount of laser light to emit before printing of the image forming apparatus 200. At the completion of the operation, the image forming apparatus 200 starts an image forming operation.

In the present exemplary embodiment, the CPU 160 always executes the image quality stabilization control before image formation. However, the CPU 160 may determine the execution timing upon power-on and/or according to use frequency.

Figure 24:
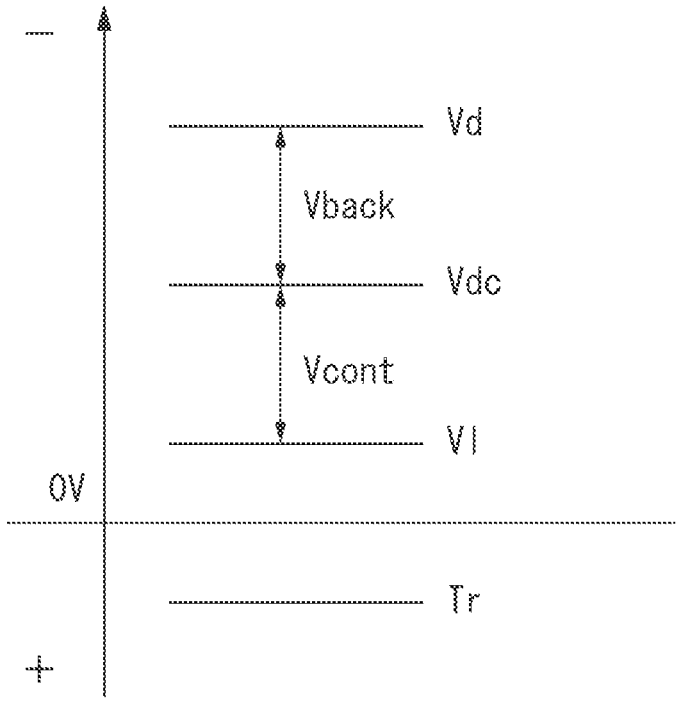
FIG. 24 is a diagram illustrating a relationship between various potentials.

Next, the flow of the image quality stabilization control according to the present exemplary embodiment will be described with reference to FIG. 24. FIG. 24 is a chart illustrating a relationship between the magnitudes of the potentials. The vertical axis indicates higher potentials of negative polarity upward.

(1) The CPU 160 determines the voltages to be applied to the charging rollers 111 from the film thickness information about the photosensitive drums 110 (information about the film thickness of the CT layers) so that the photosensitive drums 110 of respective colors have the same charged portion potential Vd. The purpose is to make the differences between the charged portion potentials Vd of the photosensitive drums 110 and potentials (transfer biases) Tr of the transfer members (primary transfer rollers 126) constant in all the process cartridges 101. Such control will be referred to as charging bias adjustment control.

(2) The CPU 160 adjusts the amounts of laser light for the exposure devices 112 to emit corresponding to the photosensitive drums 110 on which developer images of respective colors are to be formed, according to the statuses of the respective photosensitive drums 110. The CPU 160 individually adjusts the amounts of laser light to be emitted to the photosensitive drums 110 of respective colors. The purpose is to set the exposed portion potentials Vl of the photosensitive drums 110 having different degrees of use to a constant value of approximately −180 V. In other words, the purpose is to make the differences between the exposed portion potentials Vl of the photosensitive drums 110 and the potentials Tr applied to the transfer members (primary transfer rollers 126) constant in all the process cartridges 101. Such control will be referred to as light amount adjustment control.

(3) The charged portion potentials Vd and the exposed portion potentials Vl of the photosensitive drums 110 as well as the differences from the potentials Tr of the transfer members in the respective process cartridges 101 are made the same by (1) and (2). Then, the CPU 160 can make common the voltages to be applied to the transfer members.

(4) Since the charged portion potential Vd and the exposed portion potential Vl of the photosensitive drums 110 are constant, the relationship of the potentials Vd and Vl with a developing bias Vdc also becomes constant. Specifically, the CPU 160 makes constant a potential difference (back contrast Vback) between the charged portion potential Vd of the photosensitive drums 110 and the developing bias Vdc. This can prevent background fogging. The CPU 160 also makes constant a potential difference (developing contrast Vcont) between the exposed portion potential Vl of the photosensitive drums 110 and the developing bias Vdc. This can stabilize a solid image density and halftone densities.

In summary, the developing bias Vdc and the transfer bias Tr are fixed values. As will be described in detail below, the CPU 160 can also make constant the exposed portion potentials Vl and the charged portion potentials Vd by adjusting the amounts of laser light emitted from the exposure devices 112 and the voltages applied to the charging rollers 111 (charging devices) according to the states of the respective photosensitive drums 110.

Figure 19A:
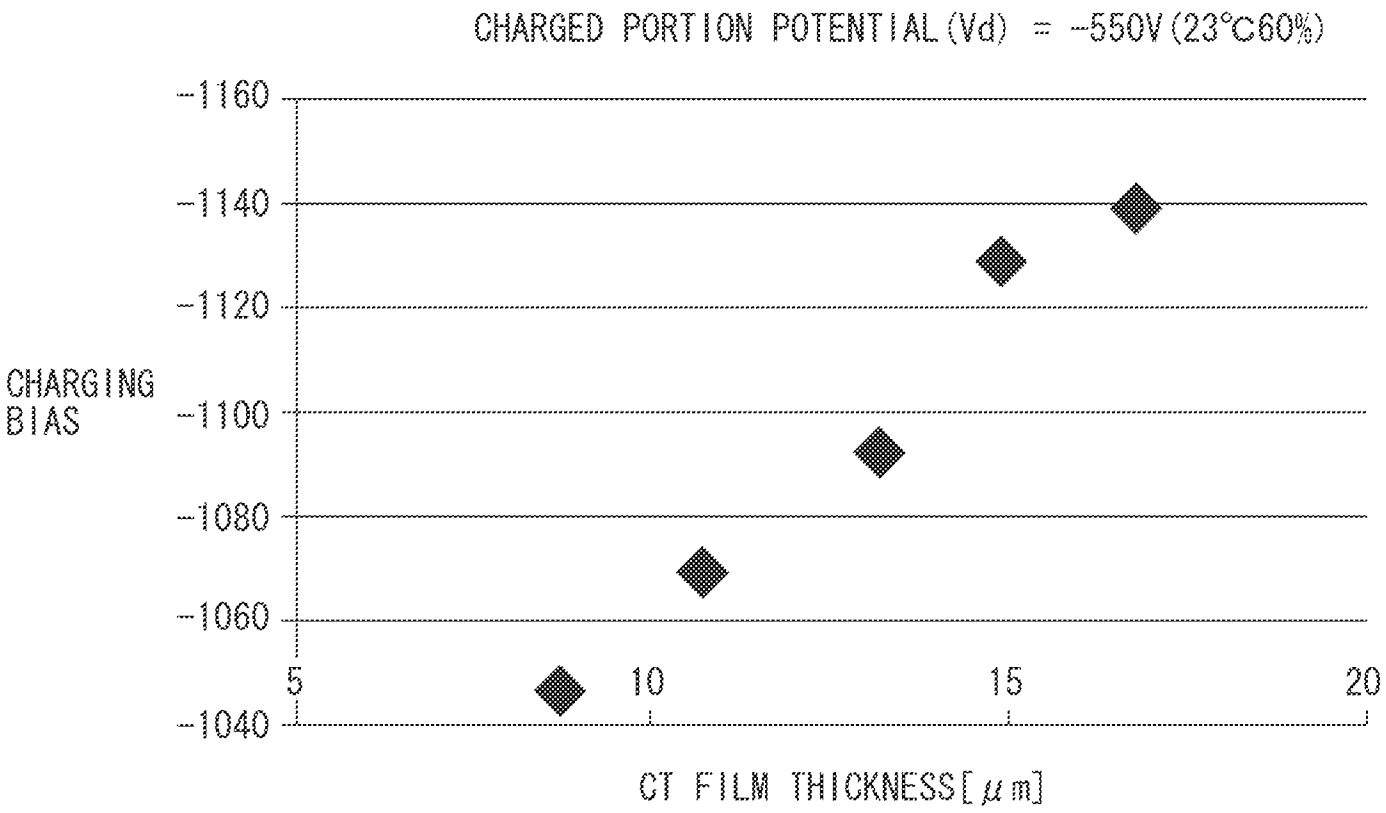
FIG. 19A is a chart illustrating a relationship between a charge carrier transport (CT) film thickness and a charging bias at a charged portion potential of Vd=−550 V.

An example of the charging bias adjustment control will be described. Suppose that photosensitive drums 110 having different CT film thicknesses of 17, 15, 13, and 11 μm are mounted on the image forming apparatus 200. In such a case, the CPU 160 changes the charging biases according to the CT film thicknesses as illustrated in FIG. 19A, whereby the charged portion potentials Vd are set to a constant value of −550 V. As illustrated in FIG. 19A, the CPU 160 determines the charging biases to apply based on the relationship between the CT film thickness and the charging bias when the charged portion potential Vd has a constant value of −550 V. The CPU 160 may obtain the CT film thicknesses from information stored in tags (not illustrated) attached to the process cartridges 101 or information stored in the image forming apparatus main body 102. Other methods may be used as long as the CT film thicknesses can be obtained.

Figure 19B:
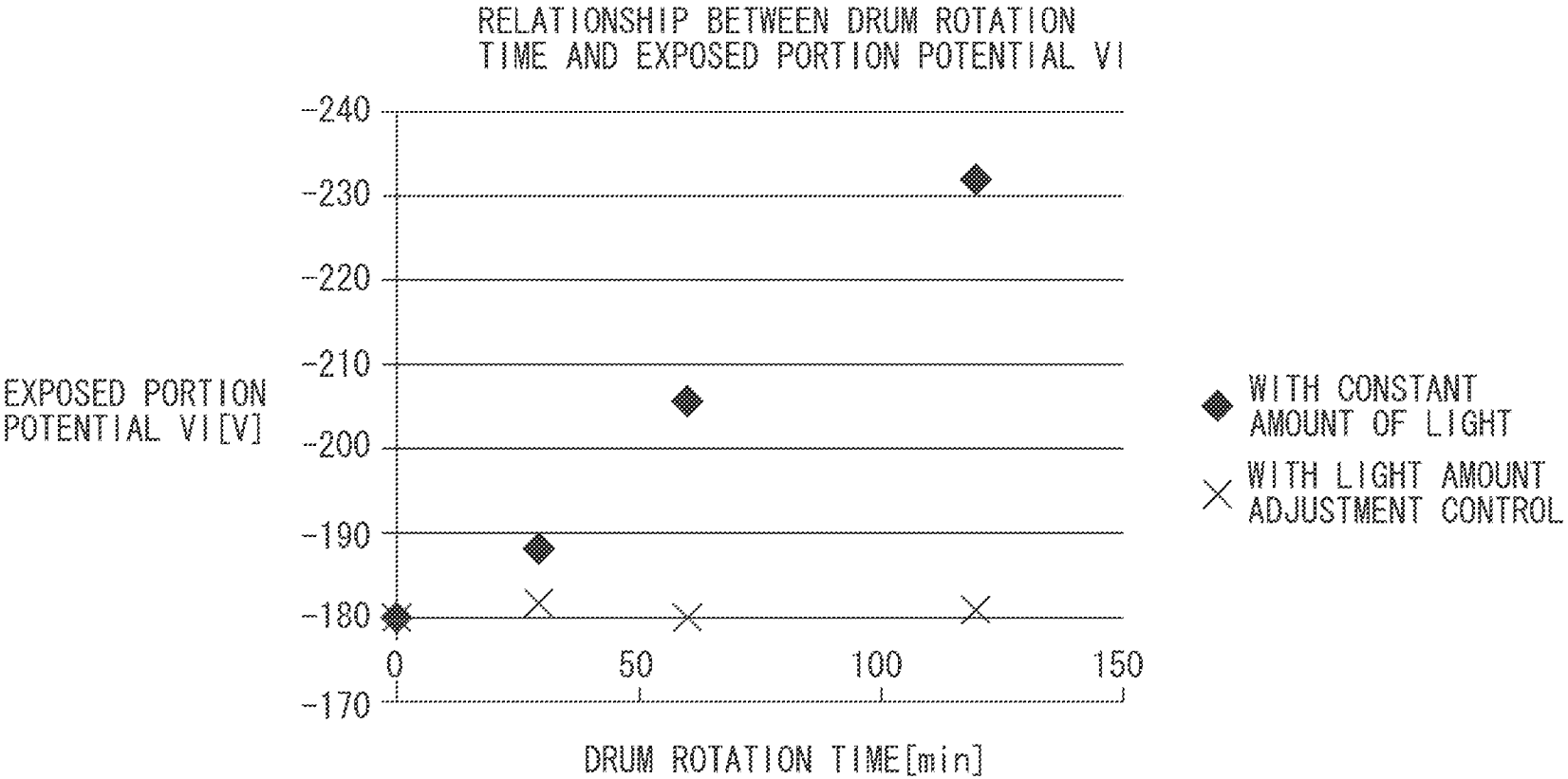
FIG. 19B is a chart illustrating a relationship between drum rotation time and an exposed portion potential Vl.

Next, an example of the light amount adjustment control will be descried. The CPU 160 initially refers to accumulated values of drum rotation time (time for which the photosensitive drums 110 are rotated) as information for determining the statuses of the photosensitive drums 110. FIG. 19B illustrates data when the exposure devices 112 emit a constant amount of light. The data shows that the absolute value of the exposed portion potential V1 increases with the accumulated value of the drum rotation time. Such a phenomenon will be referred to as a Vlup phenomenon.

As the rotation time of a photosensitive drum 110 increases, the accumulated value of the amount of exposure by which the photosensitive drum 110 has been exposed increases. This degrades the photosensitive drum 110 with a drop in the sensitivity to light. More specifically, the potential of the photosensitive drum 110 becomes less likely to attenuate after exposed by an exposure device 112. As a result, the exposed portion potential Vl tends to increase.

In consideration of the Vlup phenomenon, the CPU 160 increases the amount of laser light with the increasing drum rotation time so that the same exposed portion potential Vl can be maintained. FIG. 19B illustrates the result of the light amount adjustment control. The CPU 160 determines the amount of laser light to emit (the amount of exposure) from the obtained relationship between the drum rotation time and the amount of laser light to emit. The CPU 160 may obtain the drum rotation time from information stored in the tags attached to the process cartridges 101 or information stored in the image forming apparatus main body 102. The information shows how far the Vlup phenomena of the photosensitive drums 110 have advanced. Based on such data, the CPU 160 adjusts the amounts of exposure (the amount of laser light to emit) of the exposure devices 112.

By performing the charging bias adjustment control and the light amount adjustment control described above, the CPU 160 can make constant the potential difference between the transfer bias (primary transfer potential) Tr and the charged portion potential Vd and the potential difference between the transfer bias Tr and the exposed portion potential Vl in all the image forming units. Since the value of the transfer bias Tr can be made constant, the transfer bias power supplies can be reduced as in the present exemplary embodiment.

The CPU 160 can further make constant the potential difference (back contrast Vback) between the developing bias Vdc and the charged portion potential Vd and the potential difference (developing contrast Vcont) between the developing bias Vdc and the exposed portion potential Vl in all the stations. Since the value of the developing bias Vdc can be made constant, the developing bias power supplies can be reduced as in the present exemplary embodiment.

The back contrast Vback can thus be made constant to prevent background fogging in which lowly-charged toner (toner that is not fully charged) transfers to portions of the photosensitive drums 110 having the charged portion potential Vd. The developing contrast Vcont can be made constant to not only prevent a drop in the solid image density due to the Vlup phenomenon, but also stabilize halftone densities.

In summary, in the present exemplary embodiment, predetermined image forming units (color image forming units PY, PM, and PC) among the four image forming units PY, PM, PC, and PBk share a developing power supply (high-voltage power supply 123YMC). The developing power supply 123YMC is used to apply the common developing voltage to the developing devices 113Y, 113M, and 113C.

The color image forming units PY, PM, and PC also share a transfer power supply (high-voltage power supply 124YMC). The transfer power supply 124YMC applies the common transfer voltage to the transfer devices (primary transfer rollers 126).

According to the states (film thicknesses and sensitivities to light) of the photosensitive drums 110, the CPU 160 individually changes the voltages applied to the charging rollers 111 and the amounts of exposure (the amounts of laser light to emit) of the exposure devices 112 with respective to each of the photosensitive drums 110.

To put it another way, any two of the color image forming units (yellow, cyan, and magenta) will be referred to as image forming units A and B. The image forming units A and B share the developing power supply (high-voltage power supply 123YMC) and the transfer power supply (124YMC). In the meantime, the image forming units A and B include respective different charging power supplies 121.

As a result, the common developing voltage (developing bias) and the common transfer voltage (transfer bias) are applied to the image forming units A and B. The charging voltages (charging biases) applied to the image forming units A and B are individually (independently) controlled for the respective image forming units A and B. The control unit (CPU 160) changes the charging voltages applied to the image forming units A and B according to the states (film thicknesses) of the respective image bearing members so that the charged portion potentials Vd of the image bearing members approach the same value.

The control unit individually and independently controls the amount of exposure of the image forming unit A and that of the image forming unit B. The amounts of exposure differ even when forming images of the same density. The control unit changes the amounts of exposure by which the image forming units A and B are irradiated, according to the states (sensitivities) of the respective image bearing members. The control unit thereby makes the exposed portion potentials Vl of the image bearing members approach the same value.

The configuration of the present exemplary embodiment can make common the developing power supplies and the transfer power supplies to stabilize fogging, halftone reproducibility, and solid image density. The exposed portion potential Vl can be further stabilized from the initial stage to the final stage of life.

Next, a fifth exemplary embodiment of the present invention will be described. An image forming apparatus 200 has a basic configuration similar to that of the fourth exemplary embodiment. Similar components and elements having similar functions to those of the foregoing fourth exemplary embodiment are designated by the same reference numerals. A detailed description thereof will be omitted.

The fifth exemplary embodiment proposes a method for using a total drum light amount (an accumulated value of the amount of exposure by which a photosensitive drum 110 has been exposed) and an accumulated value of rotation time (drum rotation number) of the photosensitive drum 110 as parameters for performing the light amount adjustment control.

Figure 20A:
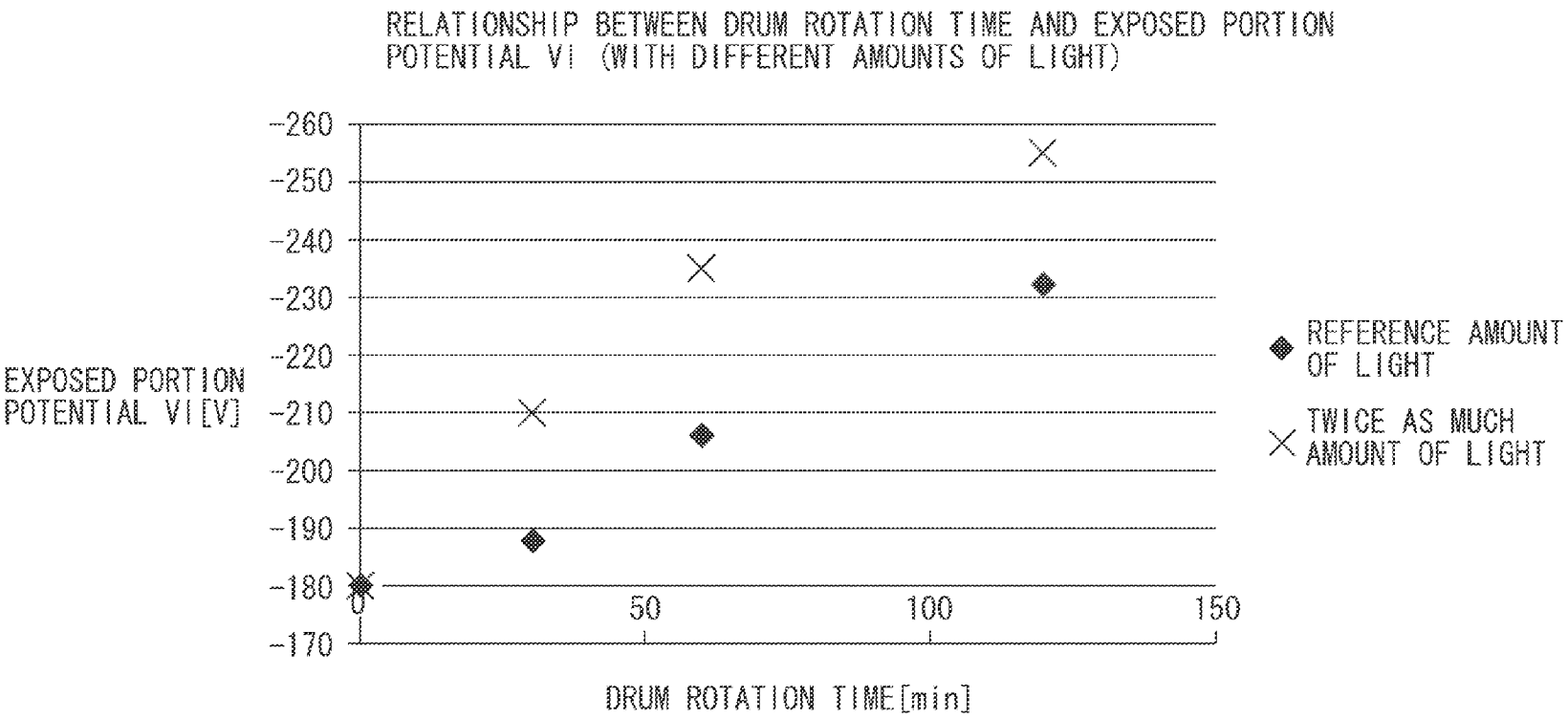
FIG. 20A is a chart illustrating a relationship between the drum rotation time and the exposed portion potential Vl with different amounts of laser light.

Initially, a relationship between the parameters and the Vlup phenomenon will be described. The Vlup phenomenon is a phenomenon resulting from sensitivity degradation of the photosensitive drum 110. The degree of the Vlup phenomenon varies with how much light the photosensitive drum 110 has been irradiated with. As illustrated in FIG. 20A, a comparison is made between when the photosensitive drum 110 receives a reference amount of light and when the photosensitive drum 110 receives twice as much amount light for the same drum rotation time. The comparison shows that the degree of the Vlup phenomenon varies. That the photosensitive drum 110 receives the reference amount of light refers to that the photosensitive drum 110 is exposed by the amount of exposure for printing an image having a printing ratio (the areal ratio of areas where an image is actually formed to areas capable of image formation) of 0.5%. That the photosensitive drum 110 receives twice as much amount of light refers to that the photosensitive drum 110 is exposed by the amount of exposure for printing an image having a printing ratio of 1%. A printing ratio of 2% doubles the area of the exposed areas of the photosensitive drum 110, and thus doubles the amount of exposure.

In the present exemplary embodiment, the CPU 160 changes the amount of laser light for the exposure device 112 to emit based on the product of the total amount of light the photosensitive drum 110 has received (the accumulated value of the amount of exposure the photosensitive drum 110 has received from the exposure device 112) and the accumulated value of the drum rotation time.

Figure 20B:
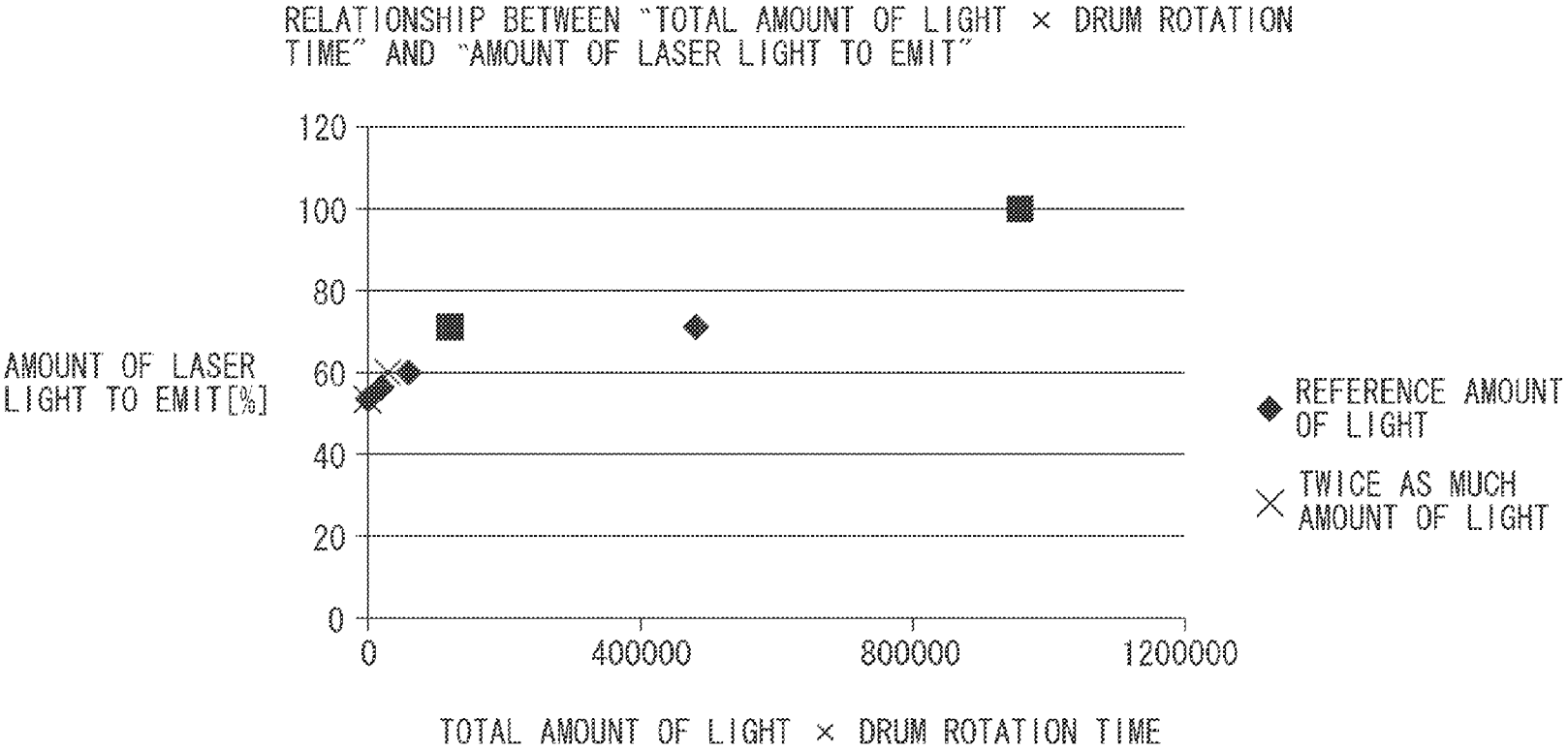
FIG. 20B is a chart illustrating a relationship between "the total amount of light×the drum rotation time" and "the amount of laser light to emit."

A description will be given with reference to FIG. 20B. The horizontal axis indicates the product of the total amount of light the photosensitive drum 110 has received and the accumulated value of the drum rotation time. The vertical axis indicates the optimum amount of light for the amount of exposure for exposing the photosensitive drum 110 during image formation. The magnitude of the amount of exposure that the photosensitive drum 110 receives in an image formation operation is proportional to the printing ratio of the image to form. In FIG. 20B, the printing ratio of the image is used as the magnitude of the amount of exposure received in a single image formation operation. The rotation time of the photosensitive drum 110 is proportional to the number of rotations of the photosensitive drum 110. The number of rotations of the photosensitive drum 110 is thus used as the rotation time of the photosensitive drum 110. In other words, "the total amount of light×the drum rotation time" on the horizontal axis of FIG. 20B is determined by the accumulated value of the printing ratio (a value obtained by accumulating the printing ratios of images each time an image is formed)×the drum rotation number. The amount of laser light to emit (the intensity of light with which a unit area is irradiated; in units of $\mu J/cm^2$) on the vertical axis is expressed with the maximum amount of laser light that the exposure device 112 used in the present exemplary embodiment can emit to expose the photosensitive drum 110 as 100%. The CPU 160 determines the actual amount of exposure according to the amount of laser light to emit on the vertical axis.

In such a manner, the CPU 160 can bring the exposed portion voltages V1 of all the image forming units (stations) closer to a constant value. The CPU 160 may obtain the total drum light amount from information stored in the tags (not illustrated) attached to the process cartridges 101 or information stored in the image forming apparatus main body 102.

In the present exemplary embodiment, the CPU 160 uses the total drum light amount (the accumulated value of the amount of exposure) and the accumulated value of the drum rotation time as the parameters indicating the degree of optical degradation of the photosensitive drum 110. However, the CPU 160 may use other parameters that indicate the degree of degradation of the photosensitive drum 110 by exposure. Examples include the accumulated value of charging time for which the photosensitive drum 110 has been charged by the charging roller 111 and the accumulated value of exposure time for which the photosensitive drum 110 has been exposed.

The CPU 160 may refer to an accumulated value of developing contact time (time for which the developing roller 116 is in contact with the photosensitive drum 110 if the developing roller 116 is configured to be capable of making contact with and separating from the photosensitive drum 110). The CPU 160 may refer to printing information such as an accumulated value of the printing ratio (the areal ratio of printed areas to the entire image formation area) and an accumulated value of the number of printed dots (the number of printed dots among the dots in an image formation area). Some image forming apparatuses perform exposure on photosensitive drums after a transfer step and before a charging step of the photosensitive drums (hereinafter, such exposure will be referred to as "pre-exposure"). The pre-exposure is intended to uniform uneven potentials of the photosensitive drums resulting from the transfer step. In such an image forming apparatus, the charging voltages and the transfer voltages may be set by referring to an accumulated value of irradiation time by the pre-exposure and/or an accumulation value of the amount of exposure by the pre-exposure.

The sensitivities of the photosensitive drums 110 to light are considered to decrease as the accumulated values increase. When exposing the photosensitive members for image formation, the amounts of exposure of the photosensitive drum can be increased as the accumulate values increase. The CT layers of the photosensitive drums 110 tend to decrease in film thickness as the accumulated values increase. When charging the photosensitive drums 110, the charging voltages applied to the charging devices (charging rollers 111) can be reduced as the accumulated values of the photosensitive drums 111 increase.

In such a manner, like the fourth exemplary embodiment, the back contrast Vback can be made constant to prevent background fogging in which lowly-charged toner transfers to areas of the photosensitive drums 110 having the charged portion potential Vd. The developing contrast Vcont can be made constant to prevent a drop in the solid image density due to the Vlup phenomenon and stabilize halftone densities.

Like the fourth exemplary embodiment, the developing power supplies and the transfer power supplies can be made common to stabilize fogging, halftone reproducibility, and solid image density. The exposed portion potential V1 can be further stabilized from the initial stage to the final stage of life.

The relationship between the total amount of light the photosensitive drum 110 has received and the drum rotation time (the product of the total amount of light and the drum rotation time) used in the present exemplary embodiment is a parameter that indicates the degree of sensitivity degradation of the photosensitive drum 110 more accurately. This improves the image quality stability as compared to the fourth exemplary embodiment.

Next, a sixth exemplary embodiment of the present invention will be described. An image forming apparatus 200 has a basic configuration similar to that of the fourth exemplary embodiment. Descriptions overlapping with those of the fourth exemplary embodiment will be omitted.

Figure 21A:
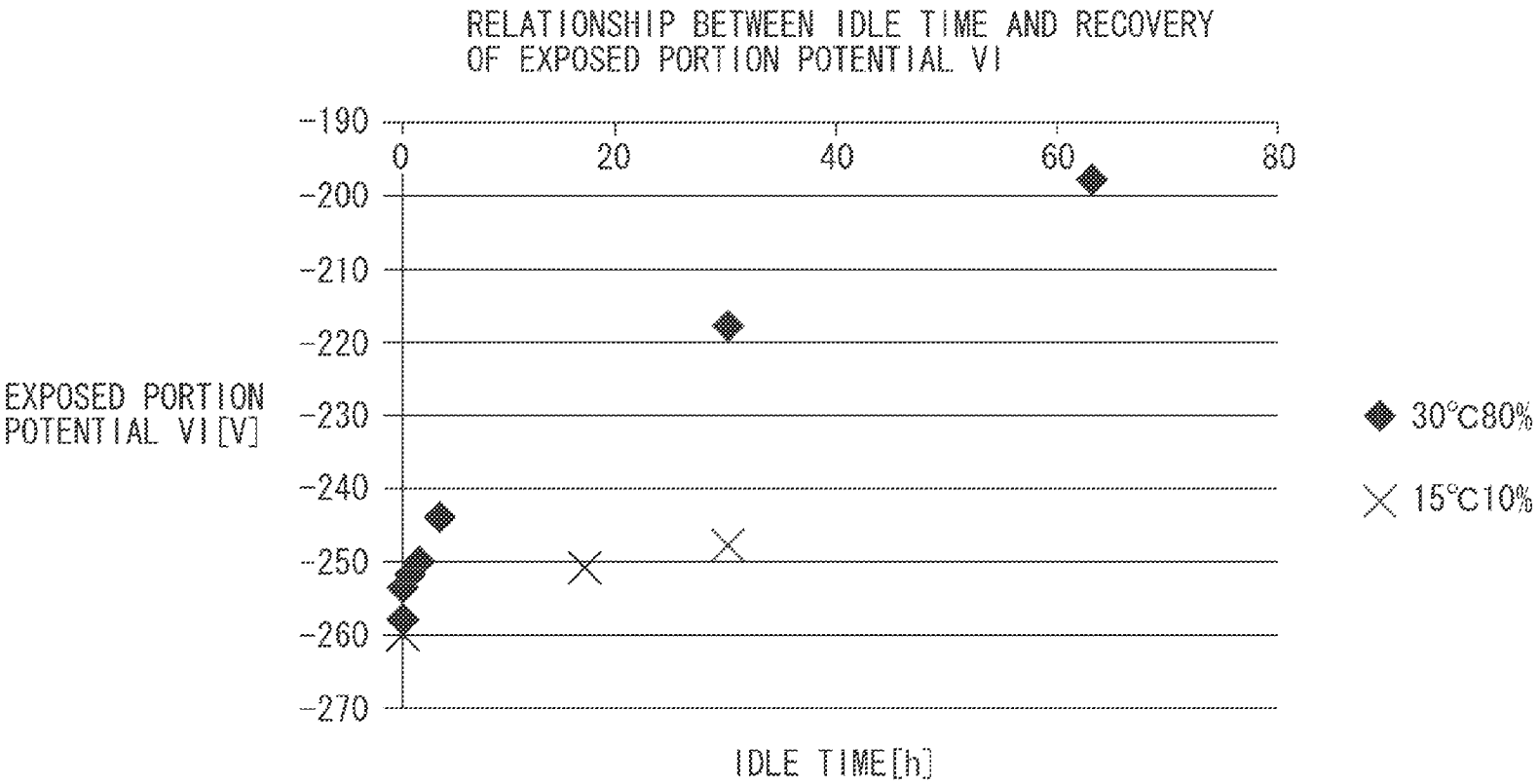
FIG. 21A is a chart illustrating a relationship between idle time and the exposed portion potential Vl.

The present exemplary embodiment proposes a light amount adjustment control that takes into consideration the recovery of the Vlup phenomenon over an idle period (stop time when no image is formed and the photosensitive drum 110 is at rest). The Vlup phenomenon is usually said to occur because carriers generated in the CG layer by exposure remain in the photosensitive drum 110. The exposed portion potential Vl may recover from the Vlup phenomenon if the carriers flow to the support substrate side of the photosensitive drum 110 or are cancelled by charges on the CT layer. FIG. 21A illustrates actual measurements of the exposed portion potential Vl over idle time after emission of the same amount of light. It can be seen that the exposed portion potential Vl recovers from the Vlup phenomenon over idle time, and the degree of recovery varies with temperature in particular.

If such recovery during an idle period is not taken into consideration and the photosensitive drum 110 is exposed by the same amount of laser light emitted as before left idle, the exposed portion potential Vl may become smaller than −180

V. If the exposed portion potential Vl decreases to −100 V, the developing contrast increases by 80 V. This deteriorates the halftone reproducibility to produce darker halftones on the whole.

In view of this, the bias applied to the developing roller 116 may be reduced by 80 V. This increases the back contrast Vback by 80 V, which in turn transfers reversed toner to cause a fogging phenomenon.

For such reasons, the CPU 160 performs the image quality stabilization control. When performing the light quality adjustment control, the image forming apparatus 200 refers to the idle period stored in the CPU 160 of the image forming apparatus main body 102 to determine the amount of laser light to emit.

Figure 21B:
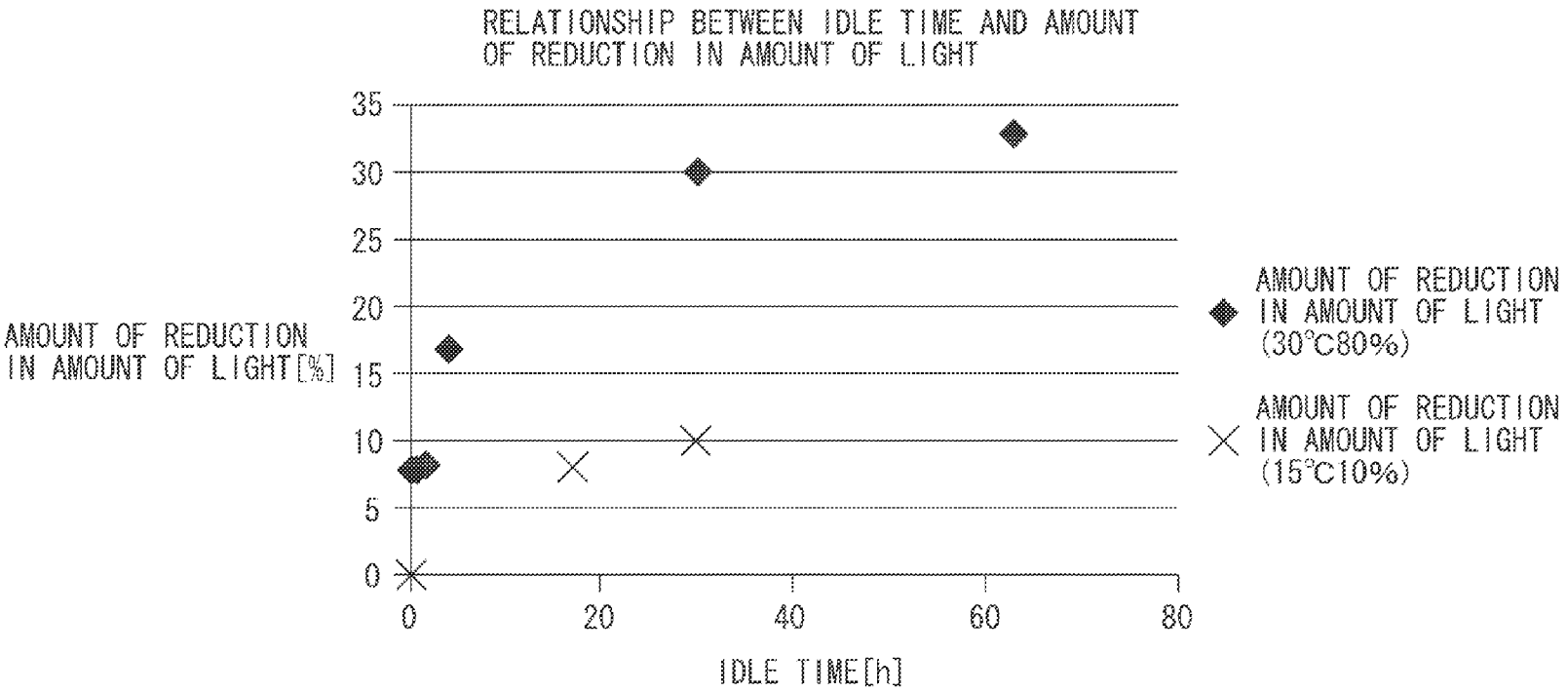
FIG. 21B is a chart illustrating a relationship between the idle time and the amount of reduction in the amount of light.

Specifically, the CPU 160 determines the amount of laser light to emit by reducing the amount of laser light to emit determined by the normal light amount adjustment control by several percent according to the idle period as illustrated in FIG. 21B. Suppose that the CPU 160 has once determined the amount of laser light to emit to be 90% by the normal light amount adjustment control. Suppose also that the photosensitive drum 110 has been left idle for an idle period of 30 hours in an environment of 30° C. in temperature and 80% in humidity. In such a case, as illustrated in FIG. 21B, the CPU 160 reduces the amount of laser light to emit by 30% and determines the amount of laser light to emit to be 60%.

In the present exemplary embodiment, like the fourth and fifth exemplary embodiments, the developing power supplies and the transfer power supplies can be made common to stabilize fogging, halftone reproducibility, and solid image density. The exposed portion potential Vl can be further stabilized from the initial stage to the final stage of life.

In the present exemplary embodiment, the information about the idle period and idle environment can be used to bring the exposed portion potential Vl closer to a constant value even in the presence of the idle period. The stabilization of the developing contrast Vcont can further improve the halftone reproducibility.

Next, a seventh exemplary embodiment of the present invention will be described. An image forming apparatus 200 has a basic configuration similar to that of the fourth exemplary embodiment. Descriptions overlapping with those of the fourth exemplary embodiment will be omitted.

The present exemplary embodiment proposes a light amount adjustment control that takes degradation of the developing device 113 into consideration. The degradation of the developing device 113 refers to a phenomenon resulting mainly from degradation of toner in the developing device 113, such that the toner can be lowly charged. The toner chargeability varies with the degree of deterioration of the developing device 113. If toner has chargeability lower than usual, the amount of toner transferring from the developing roller 113 to the photosensitive drum 110 increases to increase density even with the same developing contrast Vcont.

Figure 22A:
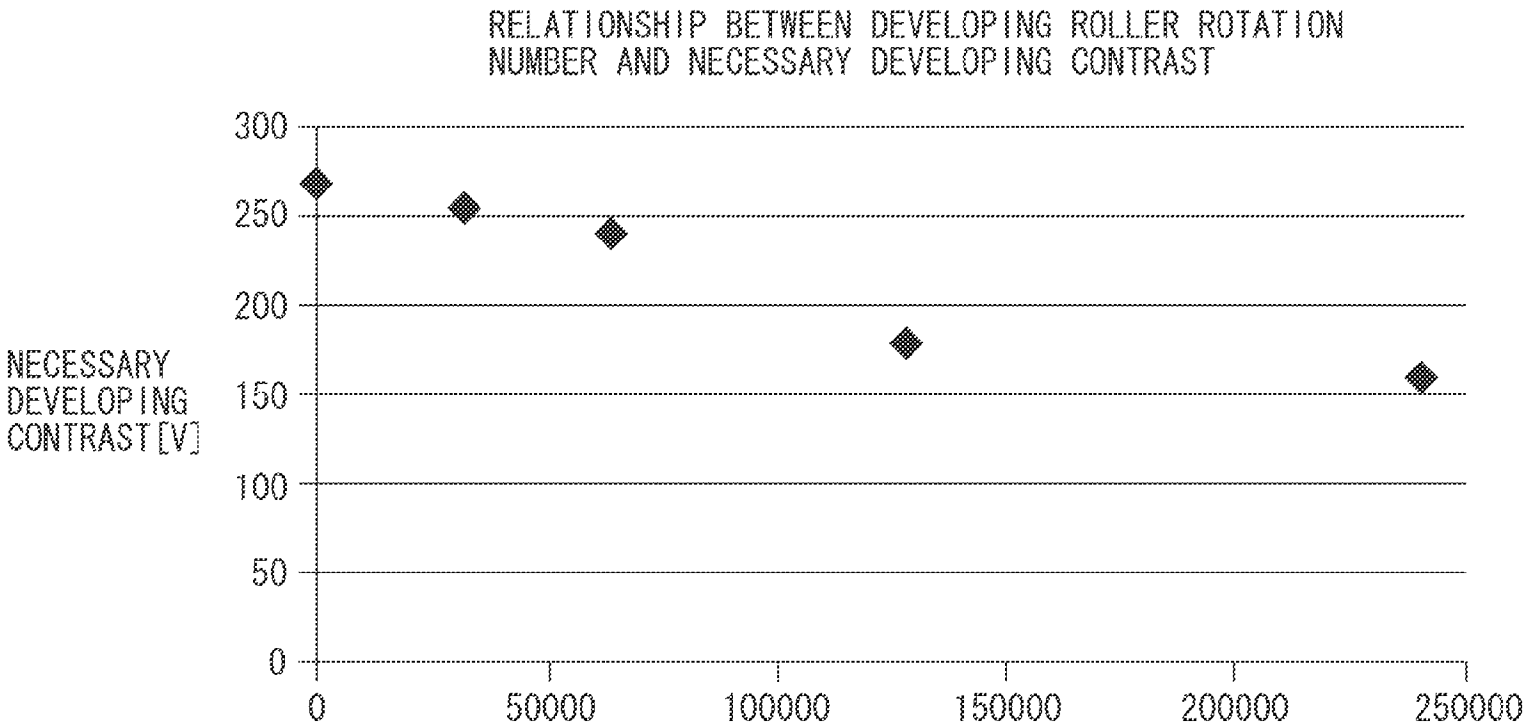
FIG. 22A is a chart illustrating a relationship between a developing roller rotation number and a necessary developing contrast.

FIG. 22A illustrates a relationship between a developing roller rotation number indicating the degree of degradation of an actual developing device 113 and developing contrast Vcont that can produce the same density. The exposed portion potential Vl is desirably increased in absolute value as an accumulated value of the amount of use of the developing device 113 (amount such as the number of rotations and the rotation time of the developing roller 116) increases. It is shown that the exposed portion potential Vl needs to be set to an appropriate value according to the degree of degradation of the developing device 113.

If the degradation of the developing device 113 is not taken into consideration and the same exposed portion potential Vl is used even when the developing roller rotation number is 24000, the amount of toner transferring from the developing roller 116 to the photosensitive drum 110 increases to produce darker halftones on the whole.

The exposed portion potential Vl can be changed to increase the difference between the exposed portion potential Vl of the photosensitive drum 110 and the potential applied to the transfer member. Such a change can be said to facilitate the occurrence of retransfer (the developer transferred from a photosensitive member 110 to the intermediate transfer belt 131 moves to another photosensitive member 110) and a transfer residual (the developer remains untransferred from the photosensitive member 110 to the intermediate transfer belt 113). In fact, the potential difference between the exposed portion potential Vl and the primary transfer potential increases by only about 100 V at most, which has little effect on the transferability (the characteristic of the developer image transferred to the intermediate transfer belt 131). Changing the exposed portion potential Vl by 100 V, however, has a high impact on the developability (the characteristic of the developer image formed on the photosensitive drum 110). Considering the degrees of impact on the developability and transferability, the image quality can be stabilized by giving higher priority to the developability which has a higher sensitivity to a potential change.

Specifically, the CPU 160 refers to a developing roller rotation number stored in the tag (not illustrated) of the process cartridge 101. Suppose that the developing roller rotation number is 24000. The data of FIG. 22A shows that the developing contrast Vcont can be 160 V. The CPU 160 then determines the exposed portion target potential Vl to be −260 V.

Figure 22B:
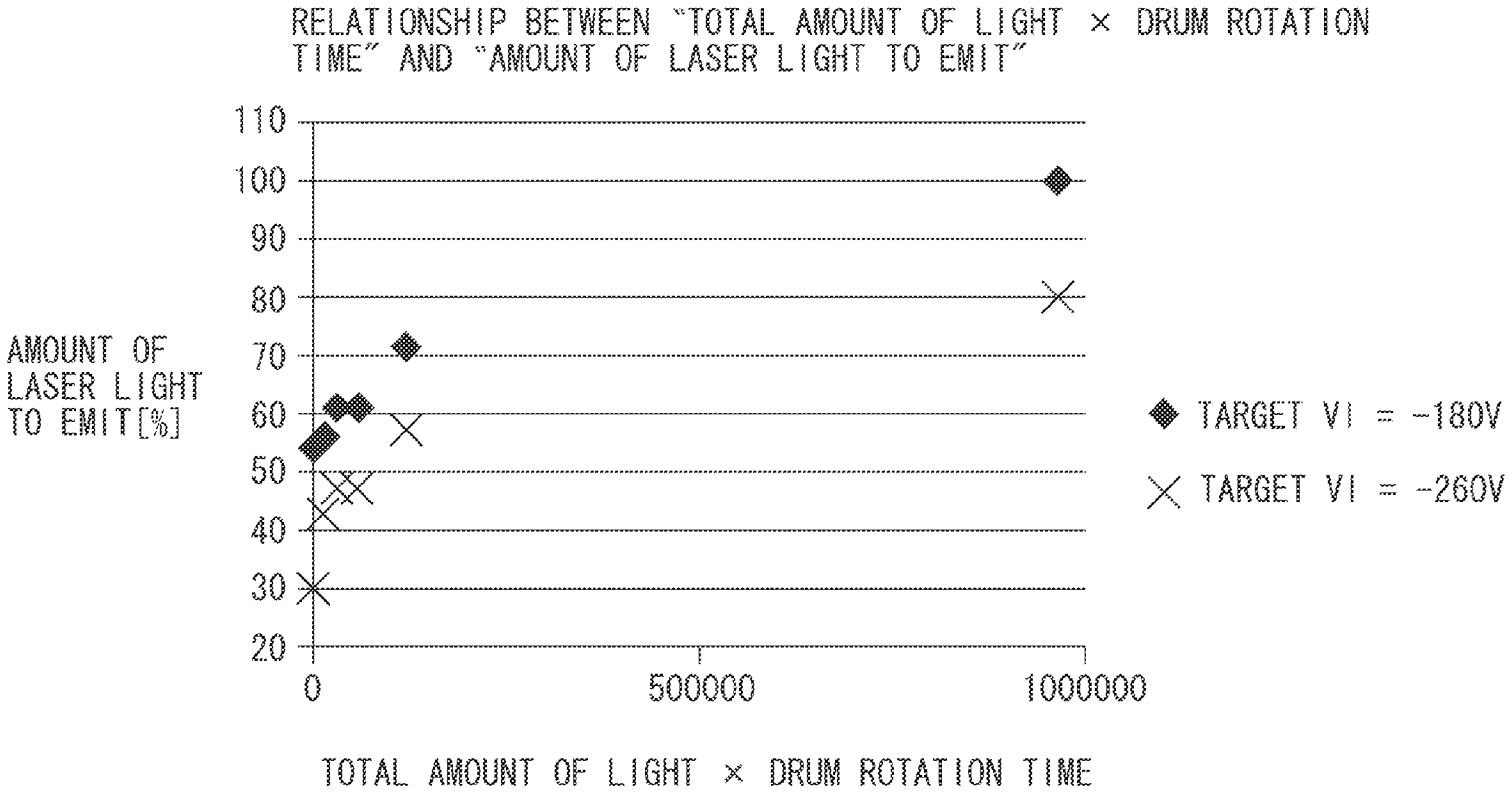
FIG. 22B is a chart illustrating a relationship between "the total amount of light×the drum rotation time" and "the amount of laser light to emit."

The CPU 160 predicts the degradation of sensitivity from the drum rotation number of the photosensitive drum 110 and the total amount of light, and determines the amount of laser light to be emitted to produce the exposed portion target potential Vl as illustrated in FIG. 22B.

In the present exemplary embodiment, like the foregoing fourth to sixth exemplary embodiments, the developing power supplies and the transfer power supplies can be made common to stabilize fogging, halftone reproducibility, and solid image density. The exposed portion potential Vl can be further stabilized from the initial stage to the final stage of life.

The present exemplary embodiment takes into consideration a change in developability depending on the degree of degradation of the developing device 113, based on the information about the developing roller rotation number. This can further improve the halftone reproducibility.

Next, an eighth exemplary embodiment of the present invention will be described.

An image forming apparatus has a basic configuration similar to that of the fourth exemplary embodiment. Descriptions overlapping with those of the fourth exemplary embodiment will be omitted.

Like the seventh exemplary embodiment, the present exemplary embodiment includes control to change the exposed portion target potential Vl according to the degree of degradation of the developing device 113.

Stations using a common transfer power supply may have different exposed portion target potentials Vl, which are adjusted according to the degrees of degradation of the respective developing devices 113. The present exemplary embodiment proposes a transfer bias adjustment control of determining the transfer bias based on a relationship between the exposed portion target potentials Vl.

Figure 23:
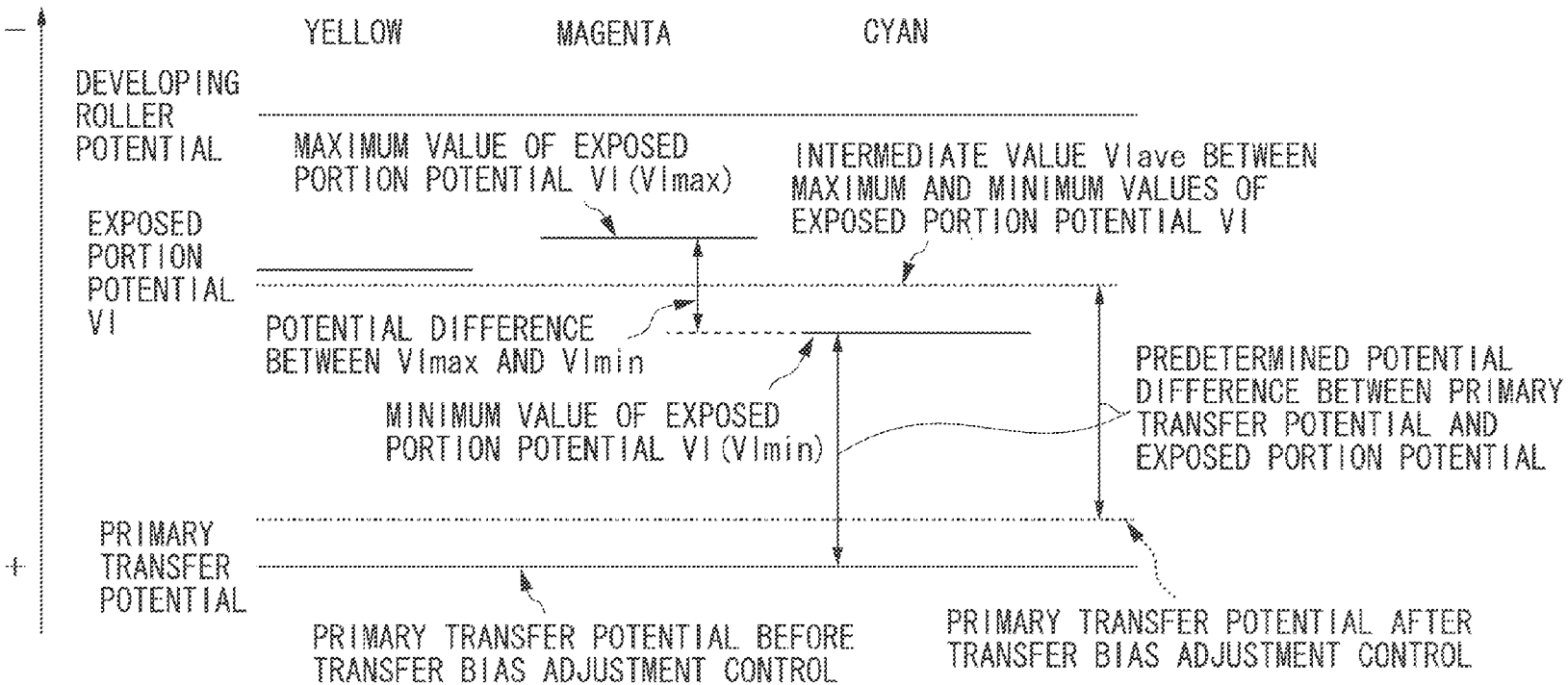
FIG. 23 is a diagram illustrating a relationship between the potentials of stations and a transfer bias setting.

FIG. 23 illustrates the relationship between the exposed portion target potentials Vl in detail. The stations have a constant developing bias and a constant transfer bias. The exposed portion target potential Vl varies with the degree of degradation of each developing device 113. In the present exemplary embodiment, the magenta station has the maximum exposed portion potential Vl (hereinafter, referred to as Vlmax) and the cyan station has the minimum exposed portion potential Vl (hereinafter, referred to as Vlmin). An intermediate value (average value) between Vlmax and Vlmin is referred to as Vlave which is illustrated by the dotted line.

The primary transfer potential is usually set to produce a potential difference of predetermined value from the exposed portion potential Vl of a new developing device 113 (here, the cyan developing device 113C is a new one). In the present exemplary embodiment, the primary transfer potential is set to the one after the transfer bias adjustment control illustrated by the dotted line, having a predetermined potential difference from the intermediate value Vlave.

In the present exemplary embodiment, the intermediate value Vlave is calculated from the exposed portion target potentials Vl of the respective stations. However, this is not restrictive. The primary transfer potential may be determined in consideration of the effects of retransfer and a transfer residual due to the degradation of toner in the developing devices 113. For example, while the present exemplary embodiment has dealt with the case of determining the primary transfer potential by using both the maximum and minimum values Vlmax and Vlmin of the exposed portion potentials Vl of the yellow, magenta, and cyan stations, the primary transfer potential may be determined based on either one of the maximum and minimum values Vlmax and Vlmin. In such a case, a difference between the minimum value Vlmin of the exposed portion potentials Vl and the primary transfer potential can be made greater than or equal to a predetermined magnitude.

Like the seventh exemplary embodiment, the exposed portion potential Vl can be changed to increase a difference between the exposed portion potential Vl of the photosensitive drum 110 and the potential applied to the transfer member. Such a change can be said to facilitate the occurrence of retransfer and a transfer residual. In fact, the potential difference between the exposed portion potential Vl and the primary transfer potential increases by only about 100 V at most, which has little effect on the transferability (the characteristic of the developer image transferred to the intermediate transfer belt 131). Changing the exposed portion potential Vl by 100 V, however, has a high impact on the developability (the characteristic of the developer image formed on the photosensitive member). Considering the degrees of impact on the developability and transferability, the image quality can be stabilized by giving higher priority to the developability which has a higher sensitivity to a potential change.

In the present exemplary embodiment, like the foregoing fourth to seventh exemplary embodiments, the developing power supplies and the transfer power supplies can be made common to stabilize fogging, halftone reproducibility, and solid image density. The exposed portion potential Vl can be further stabilized from the initial stage to the final stage of life.

In the present exemplary embodiment, the transfer bias is optimized in consideration of a change in developability depending on the degree of degradation of the developing devices 113, based on the information about the developing roller rotation numbers. This can improve transferability for further stabilization of the image quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus configured to be capable of executing a color mode for forming a color image and a monochrome mode for forming a monochrome image, the image forming apparatus comprising:

a monochrome image forming unit configured to be used both in the monochrome mode and the color mode; and a plurality of color image forming units configured to be used only in the color mode, wherein each of the monochrome image forming unit and color image forming units includes (1) an image bearing member on which a latent image is able to be formed, (2) a charging device configured to charge the image bearing member, (3) a developing device configured to develop the latent image into a developer image, and (4) a transfer portion configured to transfer the developer image from the image bearing member to a transfer member;

an exposure device configured to expose the image bearing members charged by The charging devices to form the latent images on the image bearing members; and a control unit configured to, adjust an amount of exposure by which the image bearing member is exposed and the charging voltage based on information about the image bearing member, wherein in the plurality of color image forming units, transfer voltages are applied to the respective transfer portions from a common transfer power supply and charging voltages are applied to the respective charging devices from different charging power supplies, wherein the control unit is configured to individually control the amount of exposure and the charging voltage with respect to each color image forming unit.

2. The image forming apparatus according to claim 1, wherein in the color image forming units the developing voltages are applied to the developing devices from a common developing power supply.

3. The image forming apparatus according to claim 2, wherein the developing device includes a developer bearing member configured to bear a developer and to supply the developer to the image bearing member, and wherein the developing power supply applies the developing voltages to the developer bearing members.

4. The image forming apparatus according to claim 1, wherein the developing device includes a developer bearing member configured to bear a developer and to supply the developer to the image bearing member, wherein the developer bearing member and the image bearing member are configured to be capable of making contact with and separating from each other, and wherein the control unit is configured to use an accumulated value of contact time for which the image bearing member has been in contact with the developer bearing member as the information about the image bearing member.

5. The image forming apparatus according to claim 3, wherein the developing device further includes an auxiliary member to which a voltage needs to be applied, and wherein in the color image forming units, voltages are supplied to the auxiliary members from an auxiliary member power supply shared among the color image forming units.

6. The image forming apparatus according to claim 1, wherein with a potential of an area of the image bearing member exposed by the exposure device as an exposed portion potential, the control unit is configured to change the amount of exposure by the exposure device so that the larger an amount of use of the developing device, the greater an absolute value of the exposed portion potential of the image bearing member for the developing device to develop.

7. The image forming apparatus according to claim 1, wherein a transfer power supply used in the monochrome image forming unit is different from the transfer power supply shared among the color image forming units.

8. The image forming apparatus according to claim 2, wherein a developing power supply used in the monochrome image forming unit is different from the developing power supply shared among the color image forming units.

9. The image forming apparatus according to claim 1, wherein the transfer voltages are changes according to the charging voltages.

10. The image forming apparatus according to claim 1, wherein the control unit is configured to use information about a film thickness of the image bearing member as the information about the image bearing member.

11. The image forming apparatus according to claim 1, wherein the control unit is configured to use an accumulated value of the amount of exposure by which the image bearing member has so far been exposed as the information about the image bearing member.

12. The image forming apparatus according to claim 1, wherein the control unit is configured to use an accumulated value of rotation time for which the image bearing member has so far been rotated as the information about the image bearing member.

13. The image forming apparatus according to claim 1, wherein the control unit is configured to use a product of an accumulated value of the amount of exposure by which the image bearing member has so far been exposed and the accumulated value of the rotation time for which the image bearing member has so far been rotated as the information about the image bearing member.

14. The image forming apparatus according to claim 1, wherein the control unit is configured to increase the amount of exposure by which the image bearing member is exposed as the product of the accumulated value of the amount of exposure and the accumulated value of the rotation time increases.

15. The image forming apparatus according to claim 1, wherein the control unit is configured to use an accumulated value of charging time for which the image bearing member has so far been charged by the charging device as the information about the image bearing member.

16. The image forming apparatus according to claim 1, wherein the control unit is configured to use stop time for which the image bearing member has been stopped before image formation as the information about the image bearing member.

17. The image forming apparatus according to claim 1, further comprising a pre-exposure device configured to expose the image bearing members after the developer images formed on the image bearing members are transferred to the transfer member and before the image bearing members are charged by the charging devices, wherein the control unit is configured to use an accumulated value of the amount of exposure by which the pre-exposure device has exposed each image bearing member as the information about the image bearing member.

18. The image forming apparatus according to claim 1, wherein the control unit is configured to use printing information about an image formed by the image bearing member as the information about the image bearing member.

* * * * *